US011096542B2

(12) United States Patent
Xia et al.

(10) Patent No.: US 11,096,542 B2
(45) **Date of Patent: *Aug. 24, 2021**

(54) SURFACE CLEANING APPARATUS

(71) Applicant: BISSELL Inc., Grand Rapids, MI (US)

(72) Inventors: Jincheng Xia, Shenzhen (CN); Jianjun Ge, Guangzhou (CN); Zhenjiang Yin, Shenzhen (CN); Xin Chen, Shenzhen (CN); Yongsheng Liang, Shenzhen (CN); Kam Hoi Ma, Hong Kong (CN)

(73) Assignee: BISSELL Inc., Grand Rapids, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/130,211

(22) Filed: Dec. 22, 2020

(65) Prior Publication Data

US 2021/0106200 A1 Apr. 15, 2021

Related U.S. Application Data

(63) Continuation of application No. 17/086,813, filed on Nov. 2, 2020, now Pat. No. 10,925,455, which is a (Continued)

(51) Int. Cl.

*A47L 11/30* (2006.01)
*A47L 11/40* (2006.01)

(Continued)

(52) U.S. Cl.

CPC ..... *A47L 11/302* (2013.01); *A46B 1/00* (2013.01); *A46B 9/06* (2013.01); *A46B 13/001* (2013.01);

(Continued)

(58) Field of Classification Search

CPC ..... A47L 11/302; A47L 9/04; A47L 11/4041; A47L 9/30; A47L 11/4044;

(Continued)

(56) References Cited

U.S. PATENT DOCUMENTS 1,625,147 A 4/1927 Onofrio
1,759,881 A 5/1930 Bentley (Continued)

FOREIGN PATENT DOCUMENTS

DE 1967828 U 9/1967
DE 19650565 A1 6/1998

(Continued)

OTHER PUBLICATIONS

Australian Government—IP Australia, Examination Report No. 1 for Standard Patent Application re Corresponding Application No. 2021200692, Mar. 5, 2021, 5 pages, Australia.

(Continued)

*Primary Examiner* — David Redding
(74) *Attorney, Agent, or Firm* — McGarry Bair PC

(57) ABSTRACT

A surface cleaning apparatus includes a housing including an upright handle assembly and a base mounted to the upright handle assembly and adapted for movement across a surface to be cleaned. The surface cleaning apparatus is further provided with a fluid delivery system comprising a fluid dispenser configured to dispense fluid to a brushroll and at least one fluid delivery channel forming a portion of a fluid delivery pathway. The fluid delivery channel can extend adjacent to a portion of the suction nozzle assembly. An interference wiper interfaces with a portion of the brushroll to remove excess liquid from the brushroll.

20 Claims, 21 Drawing Sheets

Related U.S. Application Data continuation of application No. 16/045,057, filed on Jul. 25, 2018, now Pat. No. 10,820,769, which is a continuation of application No. 15/331,041, filed on Oct. 21, 2016, now Pat. No. 10,092,155.

(60) Provisional application No. 62/247,503, filed on Oct. 28, 2015.

(51) Int. Cl.

| | |
|---|---|
| ***A47L 9/04*** | (2006.01) |
| ***A47L 5/28*** | (2006.01) |
| ***A47L 5/30*** | (2006.01) |
| ***A47L 7/00*** | (2006.01) |
| ***A47L 11/29*** | (2006.01) |
| ***A47L 9/30*** | (2006.01) |
| ***A46B 1/00*** | (2006.01) |
| ***A46B 9/06*** | (2006.01) |
| ***A46B 13/00*** | (2006.01) |

(52) U.S. Cl.

CPC ..... *A47L 5/28* (2013.01); *A47L 5/30* (2013.01); *A47L 7/0004* (2013.01); *A47L 7/0014* (2013.01); *A47L 9/04* (2013.01); *A47L 9/30* (2013.01); *A47L 11/29* (2013.01); *A47L 11/30* (2013.01); *A47L 11/4008* (2013.01); *A47L 11/4016* (2013.01); *A47L 11/4041* (2013.01); *A47L 11/4044* (2013.01); *A47L 11/4083* (2013.01); *A47L 11/4088* (2013.01)

(58) Field of Classification Search

CPC ..... A47L 11/4083; A47L 11/4088; A47L 5/28; A47L 5/30; A47L 7/0004; A47L 7/0014; A47L 11/29; A47L 11/30; A47L 11/4008; A47L 11/4016; A47L 11/4086; A47L 11/085; A47L 11/18; A46B 1/00; A46B 9/06; A46B 13/001

See application file for complete search history.

(56) References Cited

U.S. PATENT DOCUMENTS

| | | | |
|---|---|---|---|
| 4,168,723 | A | 9/1979 | Schneider |
| 4,266,317 | A | 5/1981 | Duda |
| 4,573,235 | A | 3/1986 | Baird, Sr. et al. |
| 4,728,942 | A | 3/1988 | England |
| 4,864,682 | A | 9/1989 | Bewley, Jr. et al. |
| 4,875,246 | A | 10/1989 | MacGregor |
| 5,086,539 | A | 2/1992 | Rench |
| 5,221,828 | A | 6/1993 | Basheer et al. |
| 5,287,581 | A | 2/1994 | Lo |
| 5,502,872 | A | 4/1996 | Chae et al. |
| 5,557,822 | A | 9/1996 | Yagi et al. |
| 5,697,119 | A | 12/1997 | Mussalo |
| 5,761,763 | A | 6/1998 | McAllise et al. |
| 5,839,159 | A | 11/1998 | Karr et al. |
| 6,041,472 | A | 3/2000 | Kasen et al. |
| 6,256,833 | B1 | 7/2001 | Steinberg |
| 6,367,120 | B2 | 4/2002 | Beauchamp |
| 6,427,730 | B2 | 8/2002 | Nagel et al. |
| 6,571,421 | B1 | 6/2003 | Sham et al. |
| 6,662,402 | B2 | 12/2003 | Giddings et al. |
| 6,753,812 | B2 | 6/2004 | Rabinowitz et al. |
| 7,048,804 | B2 | 5/2006 | Kisela et al. |
| 7,137,169 | B2 | 11/2006 | Murphy et al. |
| 7,685,671 | B2 | 3/2010 | Jansen |
| 7,823,250 | B2 | 11/2010 | Vander Baan |
| 7,967,914 | B2 | 6/2011 | Giddings et al. |
| 7,979,952 | B2 | 7/2011 | Beskow et al. |
| 8,370,991 | B2 | 2/2013 | Paliobeis et al. |
| 8,402,600 | B2 | 3/2013 | Beskow et al. |
| 8,555,446 | B2 | 10/2013 | Moes et al. |
| 8,756,752 | B2 | 6/2014 | Krondorker et al. |
| 2002/0092122 | A1 | 7/2002 | Zahuranec et al. |
| 2003/0051309 | A1 | 3/2003 | Morgan et al. |
| 2005/0086763 | A1 | 4/2005 | Moshenrose et al. |
| 2006/0288518 | A1 | 12/2006 | Lenkiewicz et al. |
| 2007/0245514 | A1 | 10/2007 | Luebbering et al. |
| 2008/0060162 | A1 | 3/2008 | Burnham |
| 2008/0092325 | A1 | 4/2008 | Vander Baan |
| 2009/0229069 | A1 | 9/2009 | Lenkiewicz et al. |
| 2010/0236010 | A1 | 9/2010 | Johnson |
| 2013/0232713 | A1 | 9/2013 | Luedke et al. |
| 2013/0318740 | A1 | 12/2013 | DeJonge et al. |
| 2014/0157543 | A1 | 6/2014 | Morphey et al. |
| 2014/0345079 | A1 | 11/2014 | Johnson et al. |
| 2015/0059123 | A1 | 3/2015 | Kasper |
| 2015/0074939 | A1 | 3/2015 | Cipolla |
| 2015/0216385 | A1 | 8/2015 | Bantum |
| 2015/0250367 | A1 | 9/2015 | Van Der Kooi et al. |
| 2015/0297047 | A1 | 10/2015 | Van Der Kooi et al. |
| 2017/0119225 | A1 | 5/2017 | Xia et al. |
| 2017/0273523 | A1 | 9/2017 | Kasper et al. |

FOREIGN PATENT DOCUMENTS

| | | | |
|---|---|---|---|
| EP | 1237459 | B1 | 6/2004 |
| EP | 2063753 | A1 | 6/2009 |
| EP | 2599420 | A1 | 6/2013 |
| EP | 2805659 | A2 | 11/2014 |
| EP | 3162262 | A2 | 5/2017 |
| GB | 2334668 | A | 9/1999 |
| GB | 2423240 | A | 8/2006 |
| JP | 2004008738 | A | 1/2004 |
| WO | 2010041184 | A1 | 4/2010 |
| WO | 2010044075 | A2 | 4/2010 |
| WO | 2011083373 | A1 | 7/2011 |
| WO | 2012107876 | A1 | 8/2012 |
| WO | 2014094833 | | 6/2014 |
| WO | 2014095614 | A1 | 6/2014 |
| WO | 2014108694 | A1 | 7/2014 |

OTHER PUBLICATIONS

Australian Government—IP Australia, Examination Report No. 1 for Standard Patent Application re Corresponding Application No. 2021200691, Mar. 5, 2021, 8 pages, Australia.

Australian Government—IP Australia, Examination Report No. 1 for Standard Patent Application re Corresponding Application No. 2020277264, Dec. 22, 2020, 6 Pages, Australia.

Australian Government—IP Australia, Examination Report No. 1 for Standard Patent Application re Corresponding Application No. 2021200690, Mar. 5, 2021, 6 pages, Australia.

European Patent Office, Extended Search Report re Corresponding Application No. 20217412.4-1016, dated May 19, 2021, 5 pages, Munich, Germany.

SURFACE CLEANING APPARATUS

CROSS REFERENCE TO RELATED APPLICATION(S)

This application is a continuation of U.S. patent application Ser. No. 17/086,813, filed Nov. 2, 2020, now U.S. Pat. No. 10,925,455, issued Feb. 23, 2021, which is a continuation of U.S. patent application Ser. No. 16/045,057, filed Jul. 25, 2018, now U.S. Pat. No. 10,820,769, issued Nov. 3, 2020, which is a continuation of U.S. patent application Ser. No. 15/331,041, filed Oct. 21, 2016, now U.S. Pat. No. 10,092,155, issued Oct. 9, 2018, which claims the benefit of U.S. Provisional Patent Application No. 62/247,503, filed Oct. 28, 2015, all of which are incorporated herein by reference in their entirety.

BACKGROUND

Multi-surface vacuum cleaners are adapted for cleaning hard floor surfaces such as tile and hardwood and soft floor surfaces such as carpet and upholstery. Some multi-surface vacuum cleaners comprise a fluid delivery system that delivers cleaning fluid to a surface to be cleaned and a fluid recovery system that extracts spent cleaning fluid and debris (which may include dirt, dust, stains, soil, hair, and other debris) from the surface. The fluid delivery system typically includes one or more fluid supply tanks for storing a supply of cleaning fluid, a fluid distributor for applying the cleaning fluid to the surface to be cleaned, and a fluid supply conduit for delivering the cleaning fluid from the fluid supply tank to the fluid distributor. An agitator can be provided for agitating the cleaning fluid on the surface. The fluid recovery system typically includes a recovery tank, a nozzle adjacent the surface to be cleaned and in fluid communication with the recovery tank through a working air conduit, and a source of suction in fluid communication with the working air conduit to draw the cleaning fluid from the surface to be cleaned and through the nozzle and the working air conduit to the recovery tank. Other multi-surface cleaning apparatuses include "dry" vacuum cleaners which can clean different surface types, but do not dispense or recover liquid.

BRIEF DESCRIPTION

An aspect of the present disclosure relates to a surface cleaning apparatus, comprising a housing including an upright handle assembly and a base operably coupled to the upright handle assembly, an agitator selectively provided with the base, a suction source, a suction nozzle in fluid communication with the suction source, a fluid delivery system including a fluid supply chamber adapted to hold a supply of liquid, a fluid dispenser provided on the base, a fluid delivery pathway between the fluid supply chamber and the fluid dispenser, and a dual wiper configuration provided with the base and comprising a first wiper adapted to contact the agitator and a second wiper at least selectively adapted to contact a surface to be cleaned.

BRIEF DESCRIPTION OF THE DRAWINGS

The present disclosure will now be described with respect to the drawings in which.

DETAILED DESCRIPTION

Figure 1:
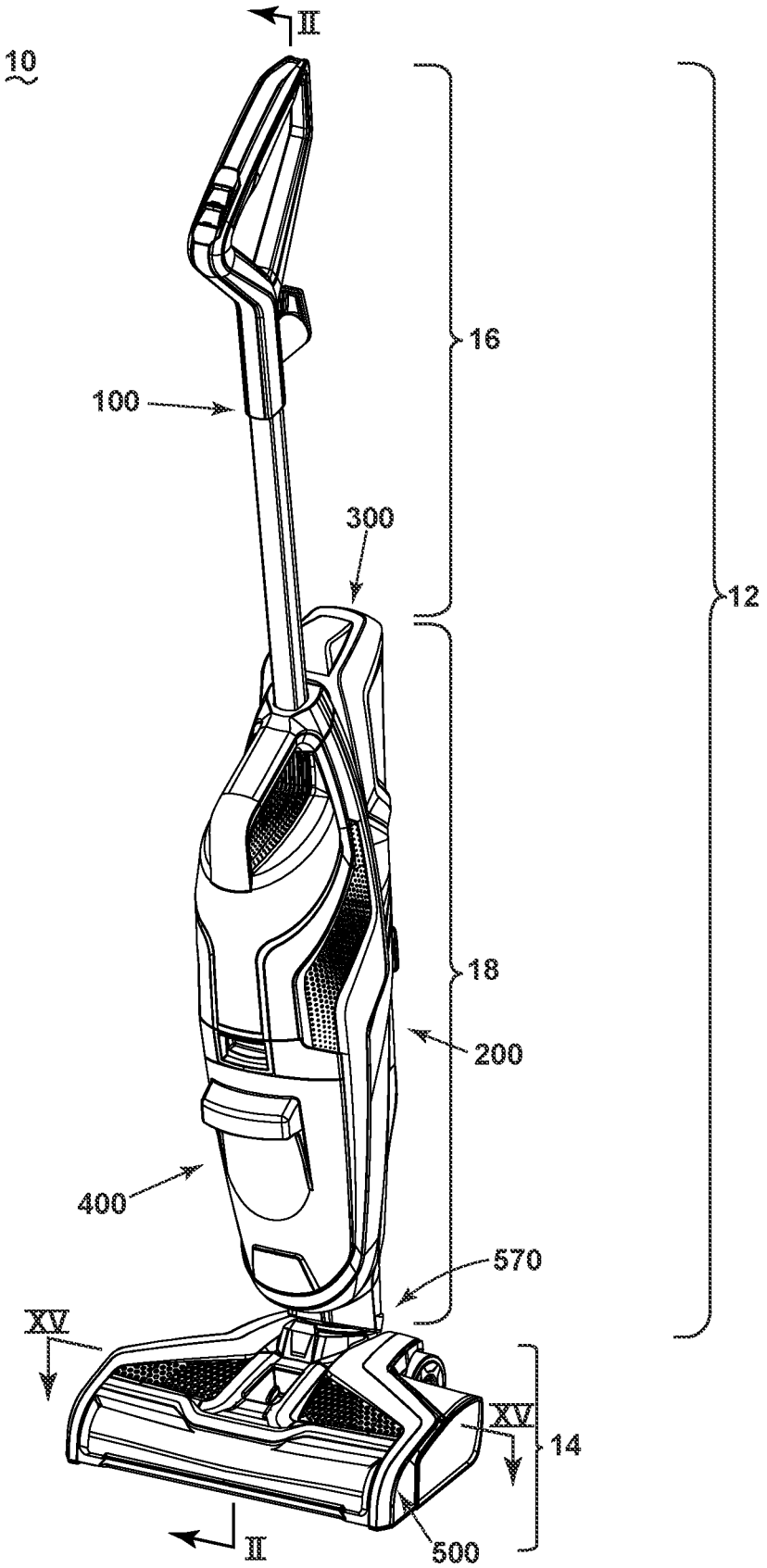
FIG. 1 is a perspective view of a surface cleaning apparatus according to one aspect of the present disclosure.

The present disclosure generally relates to a surface cleaning apparatus, which may be in the form of a multi-surface wet vacuum cleaner.

According to one aspect of the present disclosure, a surface cleaning apparatus is provided with a dual wiper configuration in the nozzle having multiple functions to reduce streaking of fluid on surface to be cleaned and improve dry debris removal. One wiper aids in distributing cleaning fluid evenly along the length of the agitator and eliminating excess fluid on the agitator, while a second wiper scrapes the surface to be cleaned while introducing fluid and debris into the suction nozzle to prevent streaking on the surface as well as to prevent dry debris scatter while agitator is activated.

According to another aspect of the present disclosure, a surface cleaning apparatus is provided with a hybrid brushroll that includes multiple agitation materials to optimize cleaning performance on different types of surfaces to be cleaned, including hard and soft surfaces, and for different cleaning modes, including wet and dry vacuum cleaning.

According to another aspect of the present disclosure, a surface cleaning apparatus is provided with integrated fluid delivery channels that reduce the number of additional components such as tubing, fittings, and clamps, which decreases the cost of manufacture and increases ease of maintenance for the user.

According to another aspect of the present disclosure, a surface cleaning apparatus is provided with a fluid dispenser configured to wet a brushroll evenly and uniformly across the entire length of the brushroll.

According to another aspect of the present disclosure, a surface cleaning apparatus is provided with a visible indicator system operably connected to cleaning fluid actuation which allows the cleaning fluid delivery flow improved visibility and feedback to the user regarding fluid delivery function.

According to another aspect of the present disclosure, a surface cleaning apparatus is provided with a storage tray that can be used during a self-cleaning mode of the surface cleaning apparatus and for drying a brushroll of the apparatus.

The functional systems of the surface cleaning apparatus can be arranged into any desired configuration, such as an upright device having a base and an upright body for directing the base across the surface to be cleaned, a canister device having a cleaning implement connected to a wheeled base by a vacuum hose, a portable device adapted to be hand carried by a user for cleaning relatively small areas, or a commercial device. Any of the aforementioned cleaners can be adapted to include a flexible vacuum hose, which can form a portion of the working air conduit between a nozzle and the suction source. As used herein, the term "multi-surface wet vacuum cleaner" includes a vacuum cleaner that can be used to clean hard floor surfaces such as tile and hardwood and soft floor surfaces such as carpet.

The cleaner can include a fluid delivery system for storing cleaning fluid and delivering the cleaning fluid to the surface to be cleaned and a recovery system for removing the spent cleaning fluid and debris from the surface to be cleaned and storing the spent cleaning fluid and debris.

The recovery system can include a suction nozzle, a suction source in fluid communication with the suction nozzle for generating a working air stream, and a recovery container for separating and collecting fluid and debris from the working airstream for later disposal. A separator can be formed in a portion of the recovery container for separating fluid and entrained debris from the working airstream. The recovery system can also be provided with one or more additional filters upstream or downstream of the motor/fan assembly. The suction source, such as a motor/fan assembly, is provided in fluid communication with the recovery container and can be electrically coupled to a power source.

The suction nozzle can be provided on a base or cleaning head adapted to move over the surface to be cleaned. An agitator can be provided adjacent to the suction nozzle for agitating the surface to be cleaned so that the debris is more easily ingested into the suction nozzle. The agitator can be driven by the same motor/fan assembly serving as the suction source, or may optionally be driven by a separate drive assembly, such as a dedicated agitator motor as shown herein.

FIG. 1 is a perspective view illustrating one non-limiting example of a surface cleaning apparatus in the form of multi-surface wet vacuum cleaner 10, according to one aspect of the present disclosure. As illustrated herein, the multi-surface wet vacuum cleaner 10 is an upright multi-surface wet vacuum cleaner having a housing that includes an upright body or handle assembly 12 and a base 14 pivotally and/or swivel mounted to the upright handle assembly 12 and adapted for movement across a surface to be cleaned. For purposes of description related to the figures, the terms "upper," "lower," "right," "left," "rear," "front," "vertical," "horizontal," "inner," "outer," and derivatives thereof shall relate to the present disclosure as oriented in FIG. 1 from the perspective of a user behind the multi-surface wet vacuum cleaner 10, which defines the rear of the multi-surface wet vacuum cleaner 10. However, it is to be understood that the present disclosure may assume various alternative orientations, except where expressly specified to the contrary.

The upright handle assembly 12 includes an upper handle 16 and a frame 18. Upper handle 16 includes a handle assembly 100. Frame 18 includes a main support section or body assembly 200 supporting at least a clean tank assembly 300 and a dirty tank assembly 400, and may further support additional components of the handle assembly 12. The base 14 includes a foot assembly 500. The multi-surface wet vacuum cleaner 10 can include a fluid delivery or supply pathway, including and at least partially defined by the clean tank assembly 300, for storing cleaning fluid and delivering the cleaning fluid to the surface to be cleaned and a fluid recovery pathway, including and at least partially defined by the dirty tank assembly 400, for removing the spent cleaning fluid and debris from the surface to be cleaned and storing the spent cleaning fluid and debris until emptied by the user.

A pivotable swivel joint assembly 570 is formed at a lower end of the frame 18 and moveably mounts the base 14 to the upright assembly 12. In the example shown herein, the base 14 can pivot up and down about at least one axis relative to the upright assembly 12. The pivotable swivel joint assembly 570 can alternatively include a universal joint, such that the base 14 can pivot about at least two axes relative to the upright assembly 12. Wiring and/or conduits supplying air and/or liquid between the base 14 and the upright assembly 12, or vice versa, can extend though the pivotable swivel joint assembly 570. A swivel locking mechanism 586 (FIG. 2) can be provided to lock and/or release the swivel joint assembly 570 for movement.

Figure 2:
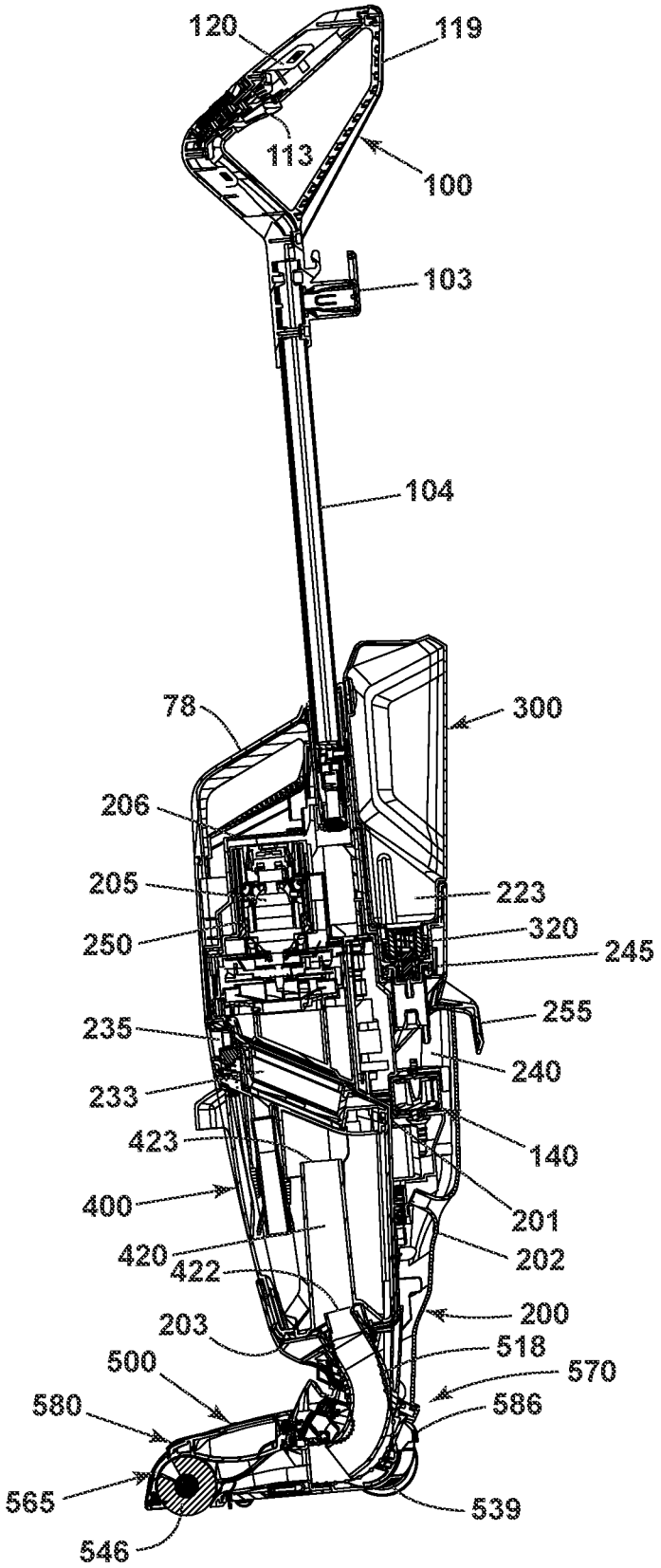
FIG. 2 is a cross-sectional view of the surface cleaning apparatus through line II-II of FIG. 1.

FIG. 2 is a cross-sectional view of the vacuum cleaner 10 through line II-II FIG. 1 according to one aspect of the present disclosure. The handle assembly 100 generally includes a handgrip 119 and a user interface assembly 120. In other examples, the user interface assembly 120 can be provided elsewhere on the vacuum cleaner 10, such as on the body assembly 200. In the present example, handle assembly 100 further includes a hollow handle pipe 104 that extends vertically and connects the handle assembly 100 to the body assembly 200. The user interface assembly 120 can be any configuration of actuating controls such as but not limited to buttons, triggers, toggles, switches, or the like, operably connected to systems in the apparatus 10 to affect and control function. In the present example, a trigger 113 is mounted to the handgrip 119 and operably communicates with the fluid delivery system of the vacuum cleaner 10 to control fluid delivery from the vacuum cleaner 10. Other actuators, such as a thumb switch, can be provided instead of the trigger 113. An upper cord wrap 103 is provided on a rear portion of the handle assembly 100.

The lower end of handle pipe 104 terminates into the body assembly 200 in the upper portion of the frame 18. Body assembly 200 generally includes a support frame to support the components of the fluid delivery system and the recovery system described for FIG. 1. In the present example, body assembly 200 includes a central body 201, a front cover 203 and a rear cover 202. Front cover 203 can be mounted to central body 201 to form a front cavity 235. Rear cover 202 can be mounted to central body 201 to form a rear cavity 240. A motor housing assembly 250 can be mounted to an upper portion of the front cover 203. A carry handle 78 can be disposed on the body assembly, forwardly of the handle assembly 100, at an angle relative to the hollow handle pipe 104 to facilitate manual lifting and carrying of the multi-surface wet vacuum cleaner 10. Motor housing assembly 250 further includes a cover 206 disposed beneath carry handle 78, a lower motor bracket 233, and a suction motor/fan assembly 205 positioned between the cover 206 and the motor bracket 233 in fluid communication with the dirty tank assembly 400.

Rear cavity 240 includes a receiving support 223 at the upper end of rear cavity 240 for receiving the clean tank assembly 300, and a pump assembly 140 beneath and in fluid communication with the clean tank assembly 300. Central body 201 is further provided with a lower cord wrap 255.

Clean tank assembly 300 can be mounted to the frame 18 in any configuration. In the present example, clean tank assembly 300 is removably mounted to the body assembly 200 such that it partially rests in the upper rear portion of the central body 201 of body assembly 200 and can be removed for filling and/or cleaning.

Dirty tank assembly 400 can be removably mounted to the front of the body assembly 200, below the motor housing assembly 250, and is in fluid communication with the suction motor/fan assembly 205 when mounted to the vacuum cleaner 10. A flexible conduit hose 518 couples the dirty tank assembly 400 to the foot assembly 500 and passes through the swivel joint assembly 570.

Optionally, a heater (not shown) can be provided for heating the cleaning fluid prior to delivering the cleaning fluid to the surface to be cleaned. In one example, an in-line heater can be located downstream of the clean tank assembly 300, and upstream or downstream of the pump assembly 140. Other types of heaters can also be used. In yet another example, the cleaning fluid can be heated using exhaust air from a motor-cooling pathway for the suction motor/fan assembly 205.

Foot assembly 500 includes a removable suction nozzle assembly 580 that can be adapted to be adjacent the surface to be cleaned as the base 14 moves across the surface and is in fluid communication with dirty tank assembly 400 through flexible conduit 518. An agitator 546 can be provided in suction nozzle assembly 580 for agitating the surface to be cleaned. Some examples of agitators include, but are not limited to, a horizontally-rotating brushroll, dual horizontally-rotating brushrolls, one or more vertically-rotating brushrolls, or a stationary brush. A pair of rear wheels 539 are positioned for rotational movement about a central axis on the rearward portion of the foot assembly 500 for maneuvering the multi-surface wet vacuum cleaner 10 over a surface to be cleaned.

In the present example, agitator 546 can be a hybrid brushroll positioned within a brushroll chamber 565 for rotational movement about a central rotational axis, which is discussed in more detail below. A single brushroll 546 is illustrated; however, it is within the scope of the present disclosure for dual rotating brushrolls to be used. Moreover, it is within the scope of the present disclosure for the brushroll 546 to be mounted within the brushroll chamber 565 in a fixed or floating vertical position relative to the chamber 565.

Figure 3:
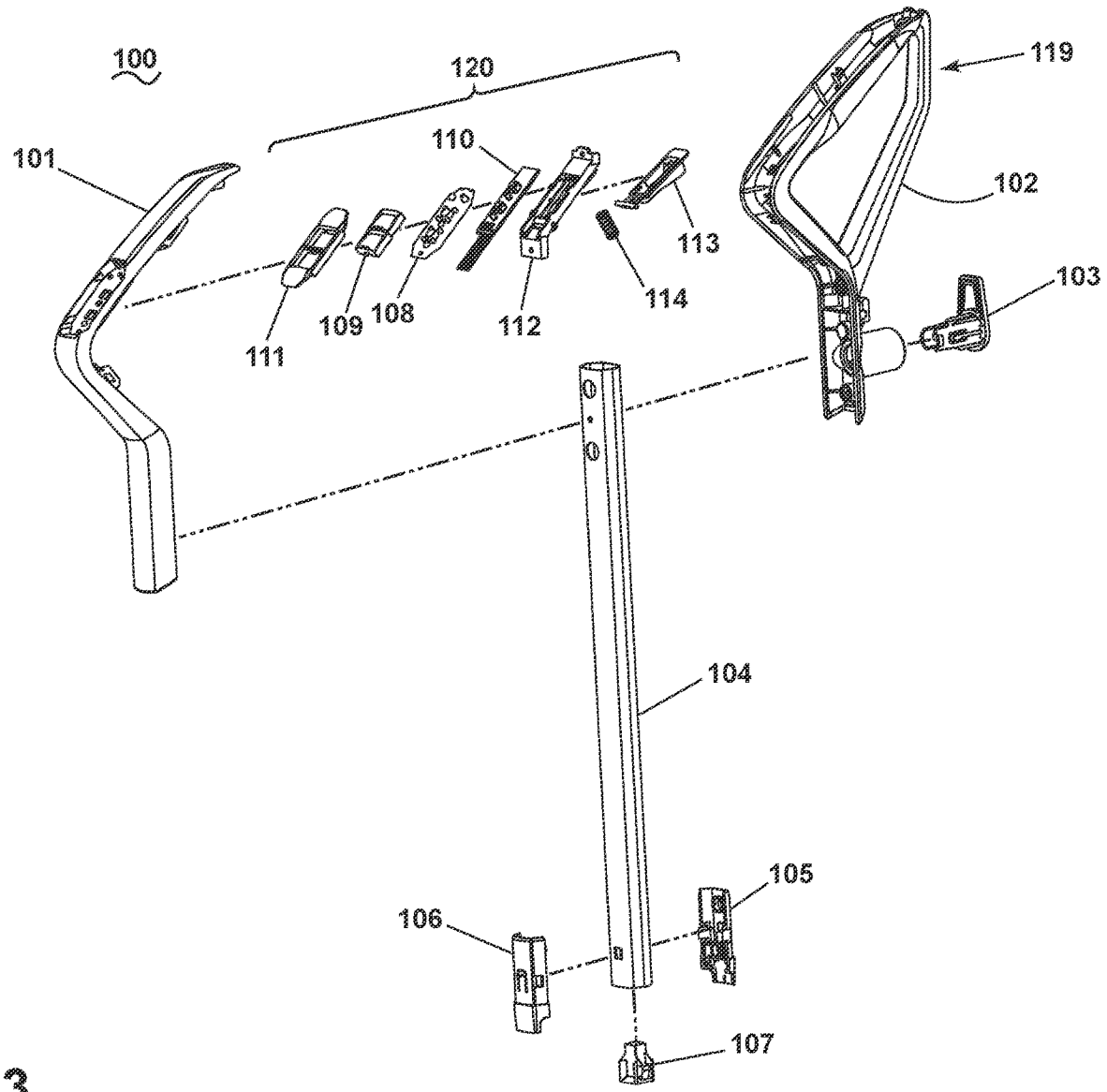
FIG. 3 is an exploded perspective view of a handle assembly of the surface cleaning apparatus of FIG. 1.

FIG. 3 is an exploded perspective view of the handle assembly 100. Handgrip 119 can include a front handle 101 and a back handle 102 mated fixedly to the handle pipe 104. The user interface assembly 120 can be provided on the front handle 101. The user interface assembly 120 of the illustrated example includes a control panel 111 connected to a floating key 109 and mounted with a water proof seal 108 through the front portion of front handle 101 to engage a printed circuit board assembly (PCBA) 110 and a bracket 112 provided on the back side of front handle 101. Bracket 112 engages a spring 114 that biases the trigger 113 mounted to the back handle 102, with a portion of the trigger 113 projecting inward in the recess formed by the mating of front handle 101 to back handle 102. The trigger 113 can electronically communicate with the fluid delivery system. The trigger 113 alternatively can mechanically communicate with the fluid delivery system, such as via a push rod (not shown) that runs through the handle pipe 104. Hollow handle pipe 104 terminates in the frame 18 (FIG. 1) by a bracket connection formed by a right bracket 106, a left bracket 105, and a female connector 107 joined together at the terminal end of handle pipe 104.

Figure 4:
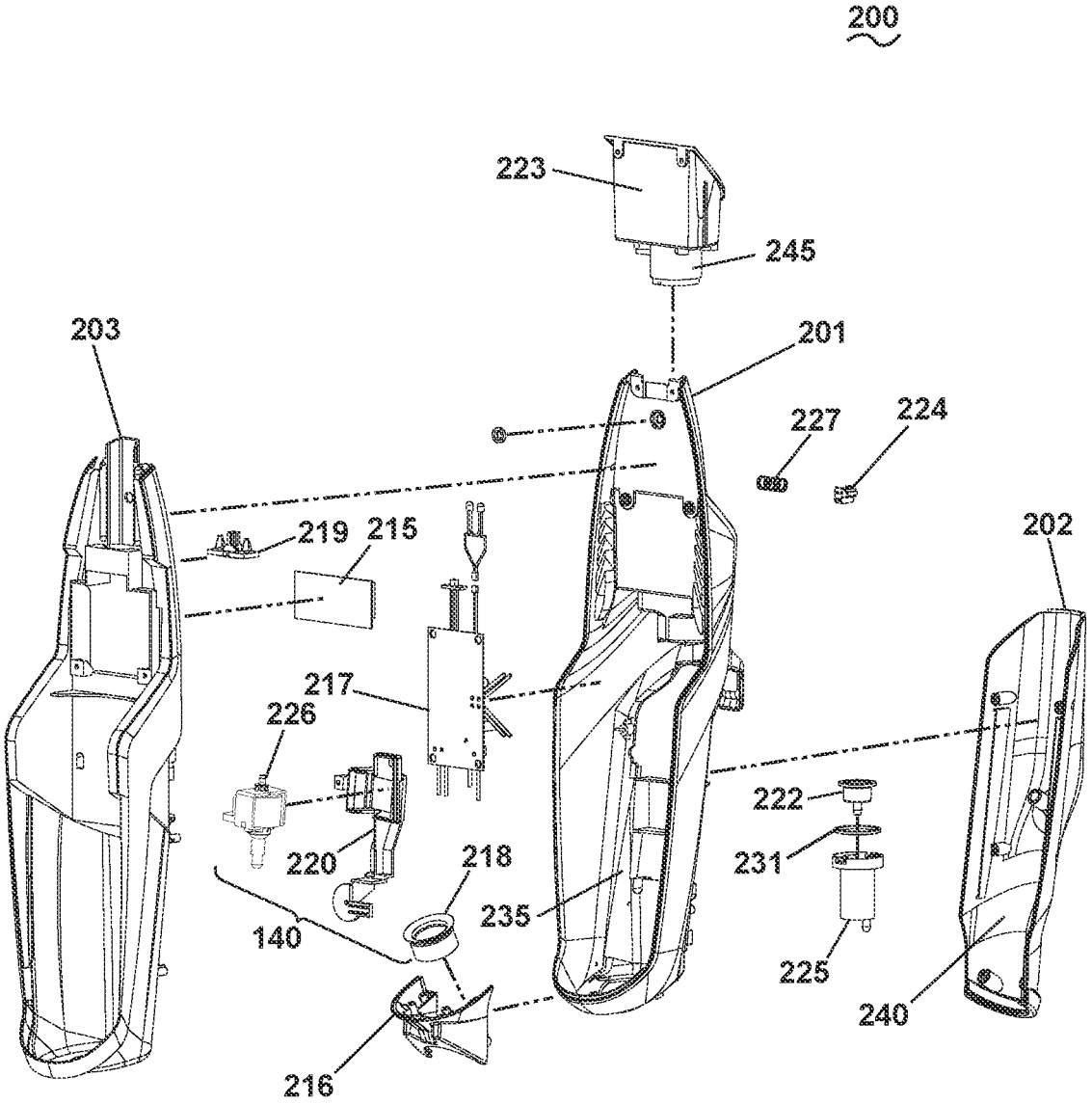
FIG. 4 is an exploded perspective view of a body assembly of the surface cleaning apparatus of FIG. 1.

FIG. 4 is an exploded perspective view of the body assembly 200. Body assembly 200 includes front cover 203, central body 201, and rear cover 202, and terminates with a bottom cover 216. Front cover 203 and rear cover 202 can mount to central body 201 forming at least partially enclosed cavities 235 and 240. In the present example, front cavity 235 generally contains electrical components such as a printed circuit board 217 (PCB) and other required circuitry 215 electrically connected to various component parts of the fluid delivery and recovery systems. Pump assembly 140 can include a connector 219, a pump 226, a clamp 220 and a gasket 218 and can be mounted in front cavity 235. Alternatively, pump assembly 140 can be mounted in rear cavity 240, or partially mounted in both front and rear cavities 235 and 240 respectively. The pump 226 can be a solenoid pump having a single, dual, or variable speed.

In the present example, rear cavity 240 generally contains a receiving assembly 245 for the clean tank assembly 300 (FIG. 2). Receiving assembly 245 can include the receiving support 223, a spring insert 227, a clamp 224, a receiving body 222, a receiving gasket 231 and a clamp cover 225 at the upper portion of rear cavity 240 for receiving the clean tank assembly 300. The pump assembly 140 can be mounted beneath and in fluid communication with the receiving assembly 245.

Figure 5:
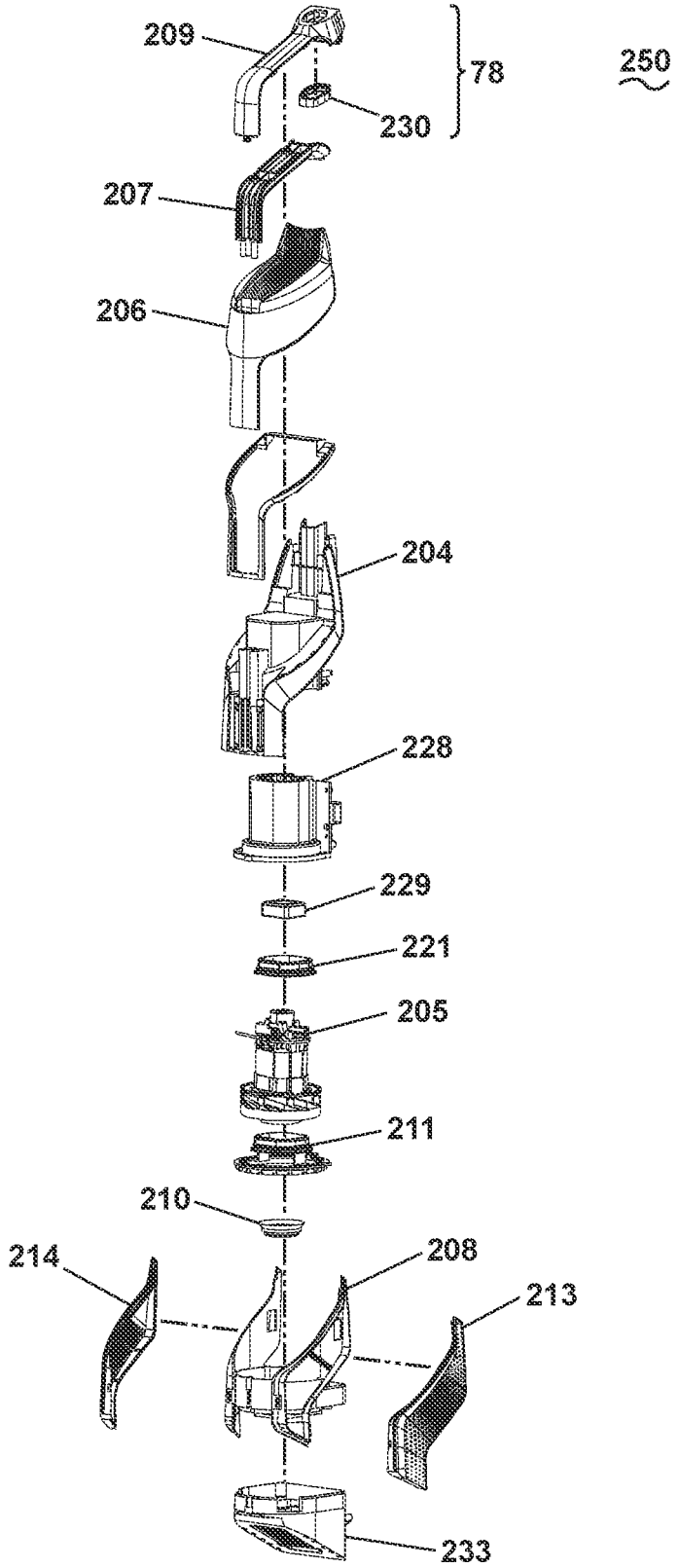
FIG. 5 is an exploded perspective view of a motor assembly of the surface cleaning apparatus of FIG. 1.

FIG. 5 is an exploded perspective view of the motor housing assembly 250. Carry handle 78 includes a handle top 209 mounted to a handle bottom 207 with a gasket 230 mounted therebetween, and is secured to the cover 206. Motor housing assembly 250 can further include an upper motor housing body 204 and a lower motor housing body 208, and a vacuum motor cover 228 provided therebetween to partially enclose the suction motor/fan assembly 205. A top motor gasket 229 and a rubber gasket 221 are provided on the upper portion of the suction motor/fan assembly 205, and lower vacuum motor gaskets 210 and 211 are provided on the lower portion of the suction motor/fan assembly 205. A clean air outlet of the working air path through the vacuum cleaner can be defined by a left vent 213 and a right vent 214 in the lower motor housing body.

Figure 6:
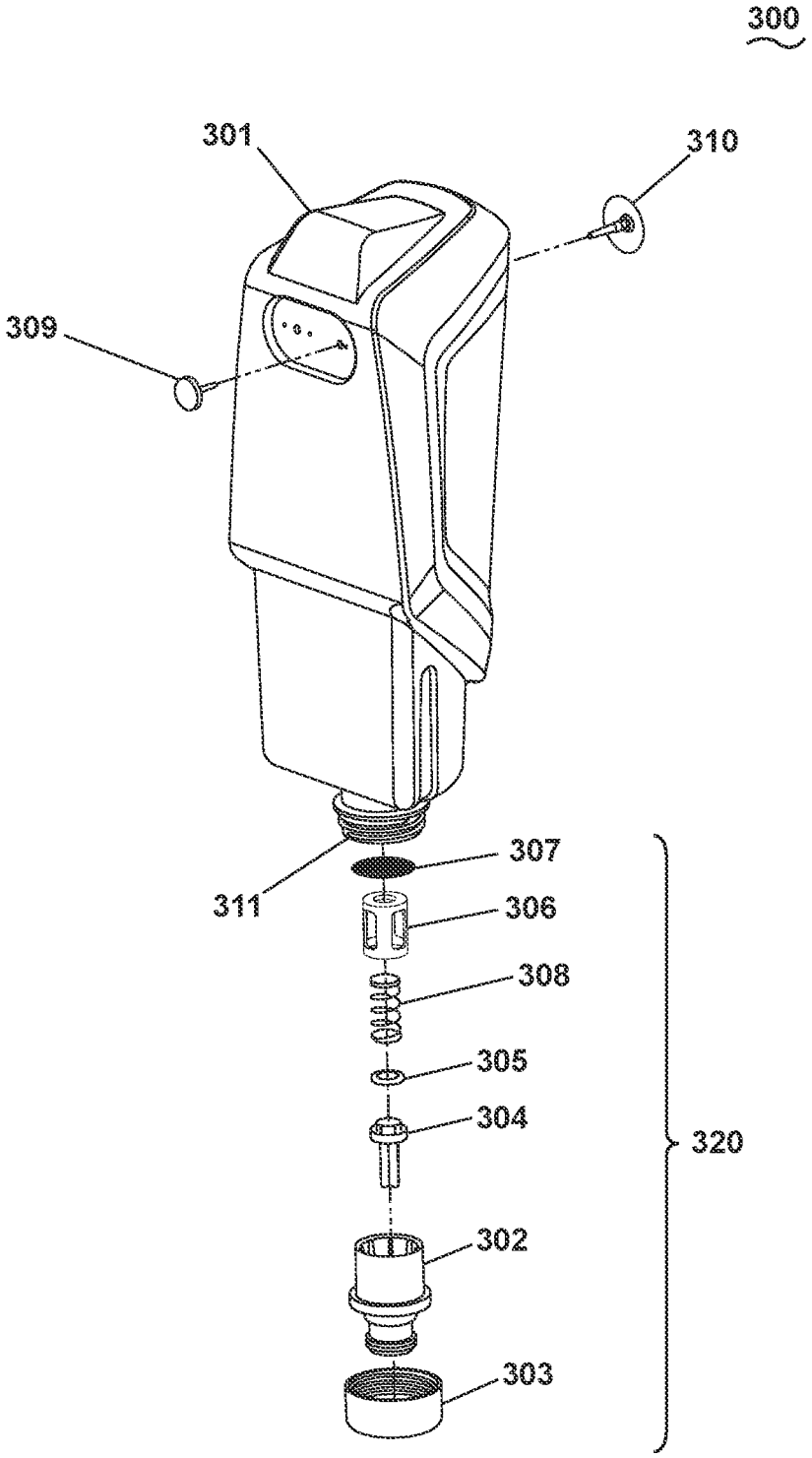
FIG. 6 is an exploded perspective view of a clean tank assembly of the surface cleaning apparatus of FIG. 1.

FIG. 6 is an exploded perspective view of the clean tank assembly 300. Clean tank assembly 300 generally includes at least one supply tank 301 and a supply valve assembly 320 controlling fluid flow through an outlet 311 of the supply tank 301. Alternatively, clean tank assembly 300 can include multiple supply chambers, such as one chamber containing water and another chamber containing a cleaning agent. A check valve 310 and a check valve umbrella 309 can be provided on supply tank 301. Supply valve assembly 320 mates with the receiving assembly 245 and can be configured to automatically open when seated. The supply valve assembly 320 includes an assembly outlet 302 that is mounted to the outlet of the fluid supply tank 301 by a threadable cap 303, a rod release insert 304 held in place with the assembly outlet 302 by an O-ring 305, and an insert spring 308 inside a spring housing 306 biasing the valve assembly 320 to a closed position. When the valve assembly 320 is coupled with the receiving assembly 245, the valve assembly 320 opens to release fluid to the fluid delivery pathway. A screen mesh insert 307 can be provided between the tank outlet and the valve outlet to prevent particulates of a certain size from entering the pump assembly 140.

Figure 7:
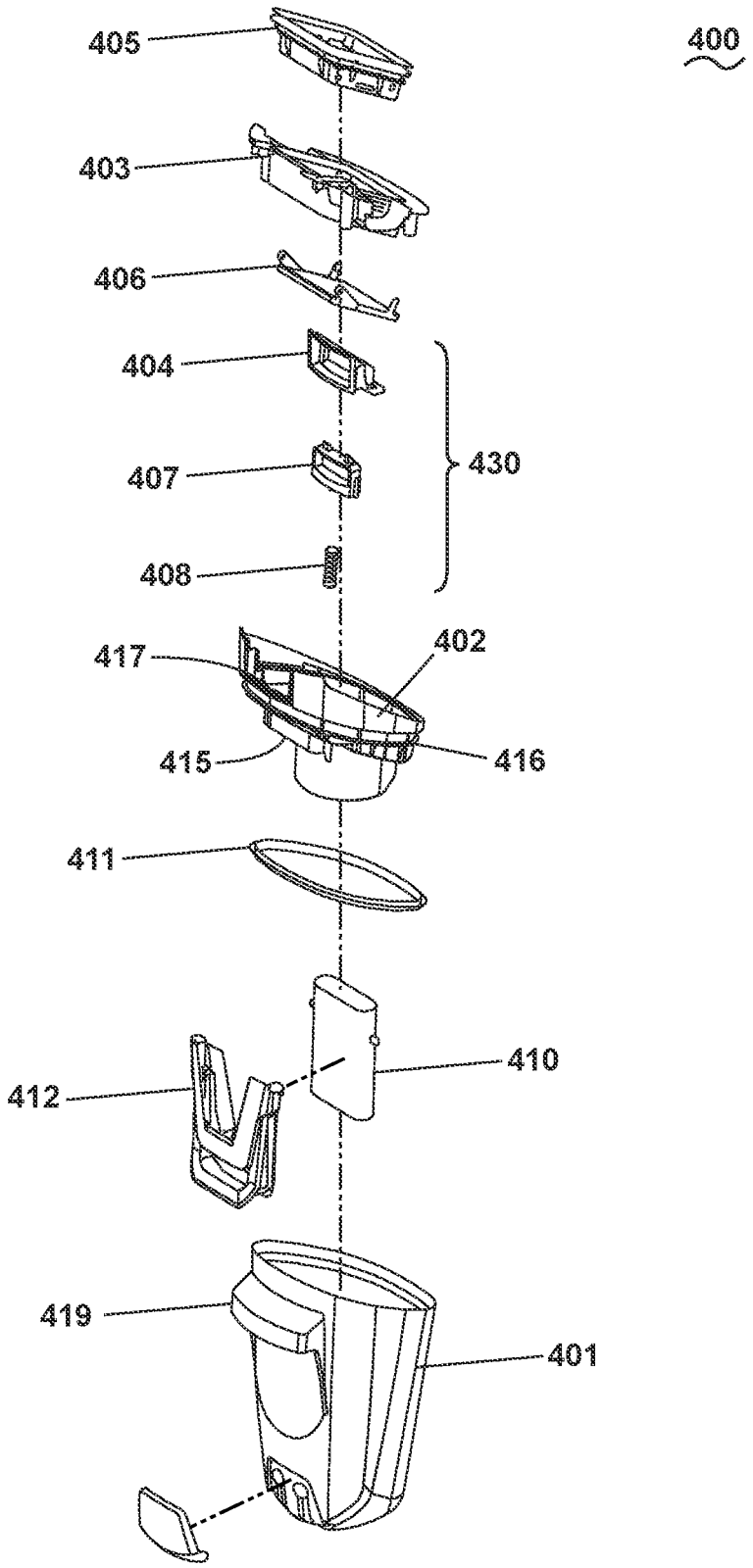
FIG. 7 is an exploded perspective view of a dirty tank assembly of the surface cleaning apparatus of FIG. 1.

FIG. 7 is an exploded perspective view of the dirty tank assembly 400. The dirty tank assembly 400 generally includes the collection container for the fluid recovery system. In the present example, dirty tank assembly 400 includes a recovery tank 401 with an integral hollow standpipe 420 (FIG. 2) formed therein. The standpipe 420 is oriented such that it is generally coincident with a longitudinal axis of the recovery tank 401. The standpipe 420 forms a flow path between an inlet 422 (FIG. 2) formed at a lower end of the recovery tank 401 and an outlet 423 (FIG. 2) on the interior of the recovery tank 401. When the recovery tank 401 is mounted to the body assembly 200 (FIG. 2), the inlet 422 is aligned with the flexible conduit hose 518 to establish fluid communication between the foot assembly 500 and the recovery tank 401. A lid 402 sized for receipt on the recovery tank 401 supports a pleated filter 405 in a filter cover plate 403 mounted to the lid 402 with a mesh screen 406 therebetween. Preferably, the pleated filter 405 is made of a material that remains porous when wet. The vacuum cleaner 10 can also be provided with one or more additional filters upstream or downstream. A gasket 411 positioned between mating surfaces of the lid 402 and the recovery tank 401 creates a seal therebetween for prevention of leaks.

A shut-off valve can be provided for interrupting suction when fluid in the recovery tank 401 reaches a predetermined level. The shut-off valve includes a float bracket 412 fixedly attached to a bottom wall 416 of the lid 402 in a position offset from the standpipe 420 and a moveable float 410 carried by the float bracket 412. The float 410 is buoyant and oriented so that the top of the float 410 can selectively seal an air outlet 415 of the recovery tank 401 leading to the downstream suction source when the fluid in the recovery tank 401 reaches a predetermined level.

A releasable latch 430 is provided to facilitate removal of the dirty tank assembly 400 for emptying and/or cleaning, and can be positioned in an aperture 417 on a front side of the lid 402. The releasable latch 430 can include a latch button 407 held within a latch bracket 404 and biased with latch spring 408 toward an engaged or latched position. The latch button 407 releasably engages with the front cover 203 to removably secure the dirty tank assembly 400 to the body assembly 200 (FIG. 2). A hand grip 419 can be provided on the recovery tank 401 and located below the latch button 407 to facilitate handling of the dirty tank assembly 400.

Figure 8:
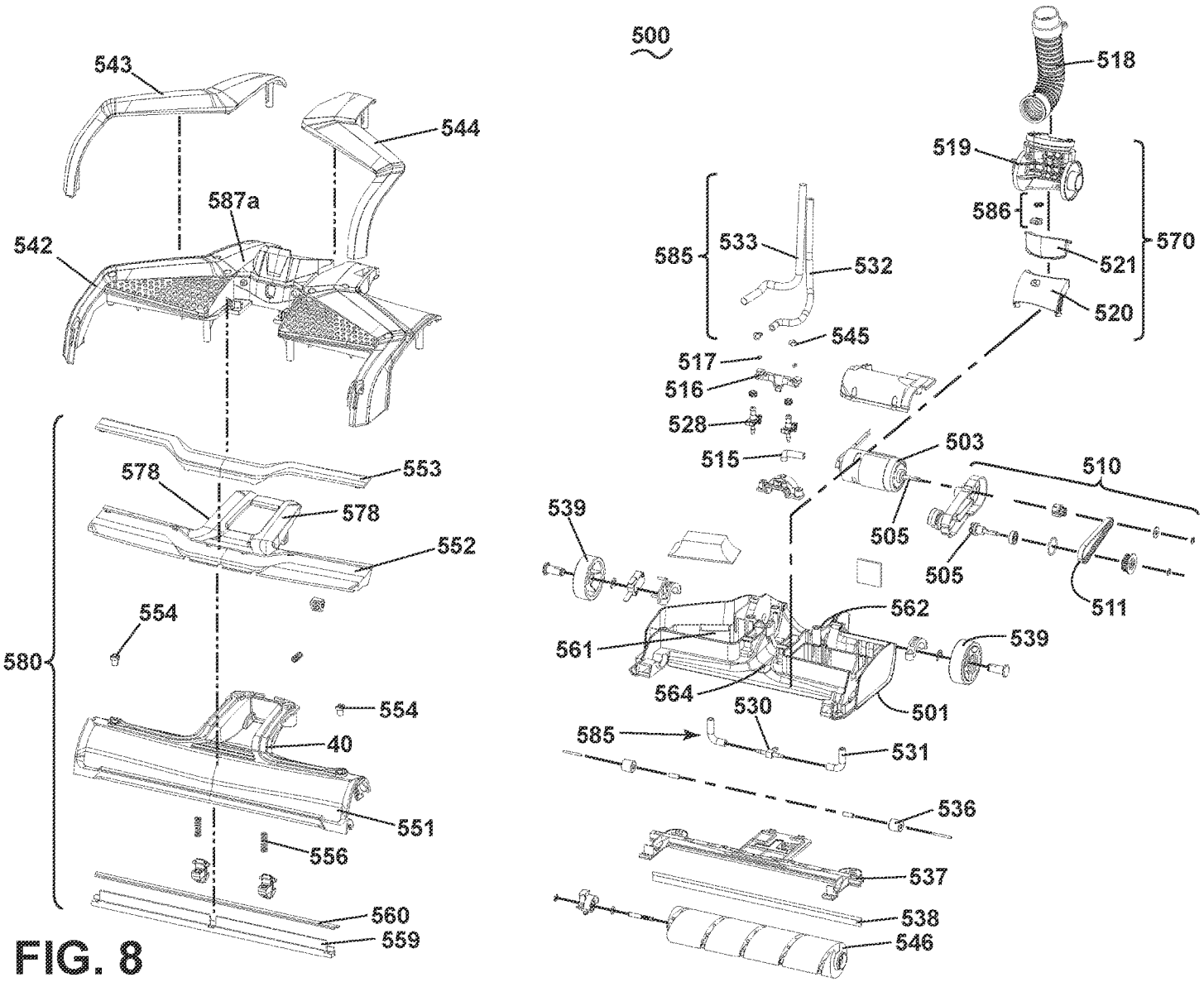
FIG. 8 is an exploded perspective view of a foot assembly of the surface cleaning apparatus of FIG. 1.
Figure 10:
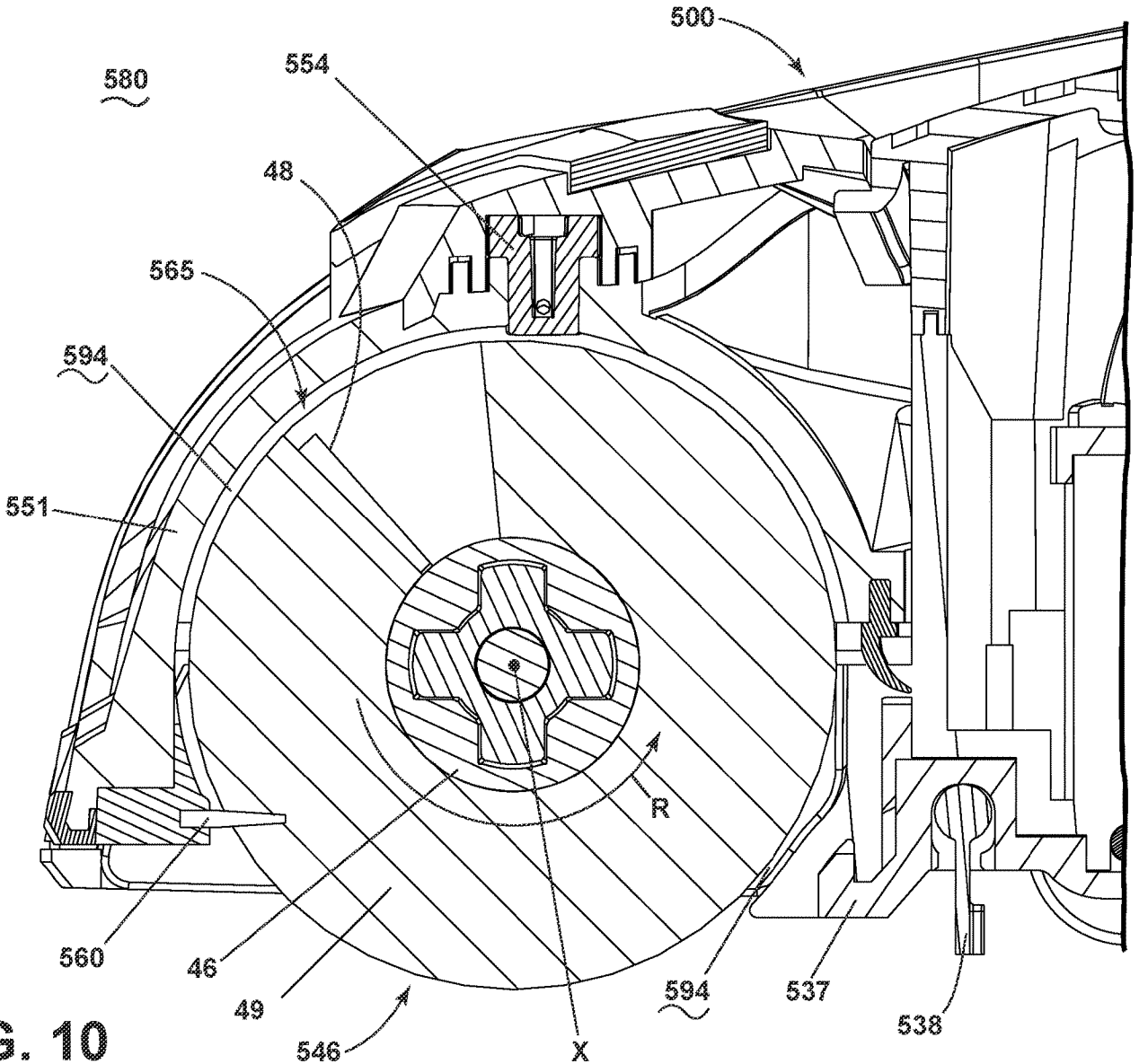
FIG. 10 is a close-up sectional view through a forward section of a suction nozzle assembly of the surface cleaning apparatus of FIG. 1.

FIG. 8 is an exploded perspective view of the foot assembly 500. Foot assembly 500 generally includes a housing supporting at least some of the components of the fluid delivery system and fluid recovery system. In the present example, the housing includes an upper cover 542 and a lower cover 501 coupled with the upper cover 542 and defining a partially enclosed cavity 561 therebetween for receiving at least some components of the fluid delivery and recovery pathways. The housing can further include a cover base 537 coupled with a lower forward portion of the lower cover to defined a portion of the brushroll chamber 565 (FIG. 10). The upper cover 542 extends from approximately the middle to rear of foot assembly 500 and can have decorative panels 543 and 544 mounted to an upper surface. Upper cover 542 can be configured to releasably receive the suction nozzle assembly 580.

Suction nozzle assembly 580 can be configured to include at least one inlet nozzle for recovering fluid and debris from the surface to be cleaned and at least one outlet for delivering fluid to the surface to be cleaned. In one example, suction nozzle assembly 580 can include a nozzle housing 551 and a nozzle cover 552 which mate to form a pair of fluid delivery channels 40 therebetween that are each fluidly connected to a spray connector 528 at one terminal end. At the opposite, or second terminal, end of each fluid delivery channel 40, a fluid dispenser 554 is configured with at least one outlet to deliver fluid to the surface to be cleaned. Fluid dispenser 554 may be included of one or more spray tips configured to deliver cleaning fluid from the fluid delivery channel 40 to the brush chamber 565. In the present example, fluid dispenser 554 is a pair of spray tips fluidly connected to the fluid delivery channel 40. Spray tip 554 is mounted in the nozzle housing 551 and has an outlet in fluid communication with the brush chamber 565. Nozzle cover 552 can have a decorative cover 553, and one or both can be composed of a translucent or transparent material. Nozzle housing 551 can further include a front interference wiper 560 mounted at a forward position relative to the brushroll chamber 565 and disposed horizontally.

The lower cover 501 further includes a plurality of upstanding bosses 562 that project into cavity 561 for mounting interior components thereto. A rear portion of the lower cover 501 pivotally mounts to swivel joint assembly 570 for maneuvering the multi-surface wet vacuum cleaner 10 over a surface to be cleaned. The rear wheels 539 are positioned for rotational movement about a central axis on opposite sides of the lower cover 501 for maneuvering the multi-surface wet vacuum cleaner 10 over a surface to be cleaned. Swivel joint assembly 570 can be included of swivel joint 519, covers 520 and 521, and a swivel locking mechanism 586 for releasing the swivel joint assembly 570 for pivoting and swivel movements.

A conduit assembly 585 is partially disposed in cavity 561 and extends through the swivel joint 519, along with the flexible conduit hose, to couple with components in the upper body assembly 200 (FIG. 2). Conduit assembly 585 includes a fluid supply conduit 532 and a wiring conduit 533. Fluid supply conduit 532 passes interiorly to swivel joint assembly 570 and fluidly connects the clean tank assembly 300 to the spray connectors 528 through a T-connector 530 having a pair spray tube connectors 531. Wiring conduit 533 provides a passthrough for electrical wiring from the upright assembly 12 to the base 14 through swivel joint assembly 570. For example, the wiring can be used to supply electrical power to at least one electrical component in the foot assembly 500. One example of an electrical component is a brush motor 503. Another example is an indicator light assembly. In the present example, the indicator light assembly includes an LED base 516 configured to mount a pair of indicator lights 517 and a pair of lenses 545 over the lights 517. The lights 517 may include light emitting diodes (LED) or other illumination sources.

A central lower portion of the partially enclosed cavity 561 and a rearward lower portion of suction nozzle assembly 580 can be molded to form a foot conduit 564 of the fluid recovery pathway that is fluidly connected to the flexible conduit 518. Flexible conduit 518 fluidly connects dirty tank assembly 400 (FIG. 2) to suction nozzle assembly 580.

The brushroll 546 can be provided at a forward portion of the lower cover 501 and received in brushroll chamber 565. In the present example, the cover base 537 rotatably receives the brushroll 546, and also mountably receives a wiper 538 positioned rearwardly of the brushroll 546. Optionally, brushroll 546 can be configured to be removed by the user from the foot assembly 500 for cleaning and/or drying. A pair of forward wheels 536 are positioned for rotational movement about a central axis on the terminal surface of the cover base 537 for maneuvering the multi-surface wet vacuum cleaner 10 over a surface to be cleaned.

In the example, the brushroll 546 can be operably coupled to and driven by a drive assembly including a dedicated brush motor 503 disposed in the cavity 561 of the lower cover 501 and one or more belts, gears, shafts, pulleys or combinations thereof to provide the coupling. Here, a transmission 510 operably connects the motor 503 to the brushroll 546 for transmitting rotational motion of a motor shaft 505 to the brushroll 546. In the present example, transmission 510 can include a drive belt 511 and one or more gears, shafts, pulleys, or combinations thereof. Alternatively, a single motor/fan assembly (not shown) can provide both vacuum suction and brushroll rotation in the multi-surface wet vacuum cleaner 10. A brush motor exhaust tube 515 can be provided to the brush motor 503 and configured to exhaust air to the outside of the multi-surface wet vacuum cleaner 10.

Figure 9:
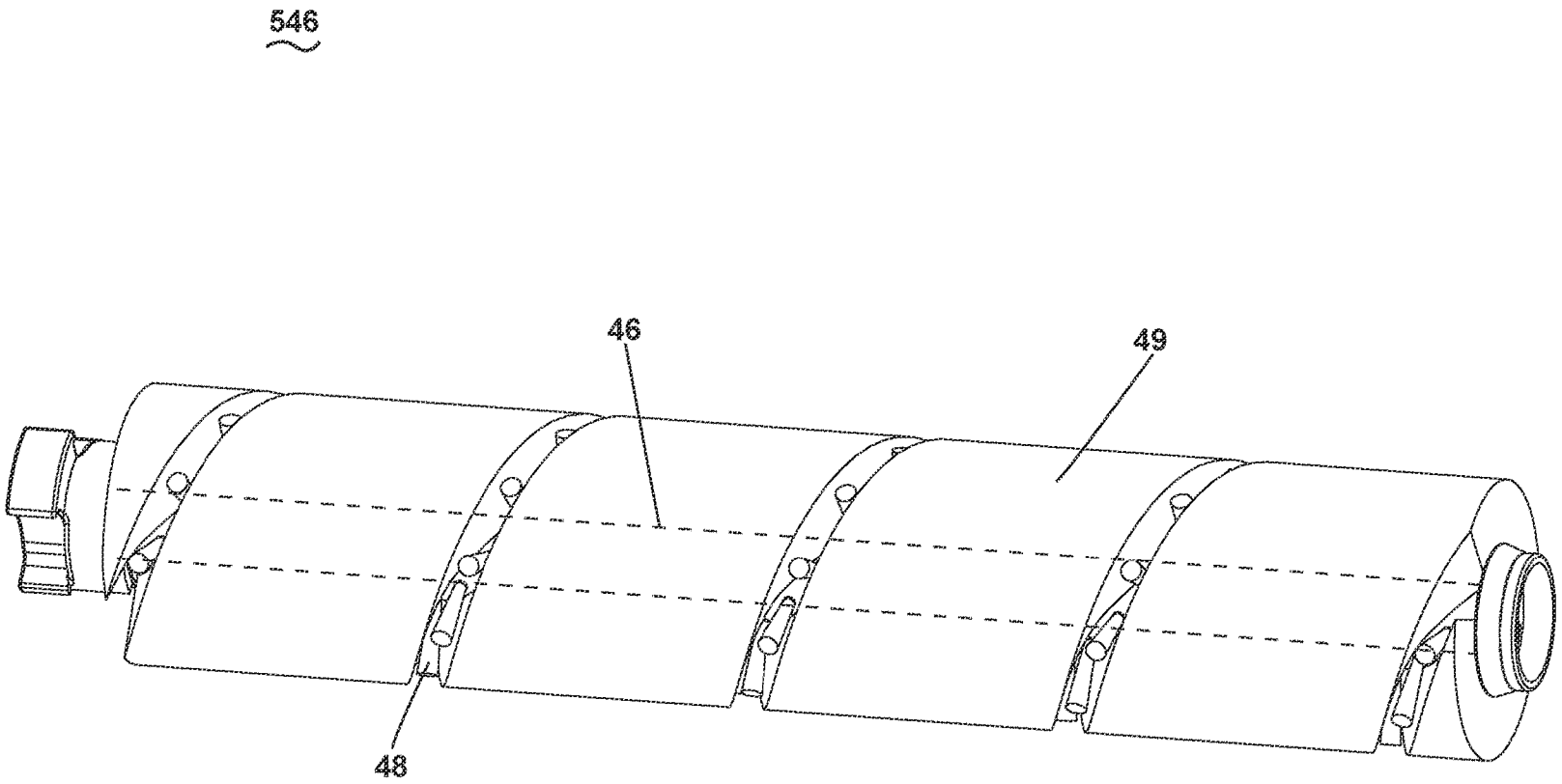
FIG. 9 is a perspective view of a brushroll of the surface cleaning apparatus of FIG. 1.

FIG. 9 is a perspective view of the hybrid brushroll 546. Hybrid brushroll 546 is suitable for use on both hard and soft surfaces, and for wet or dry vacuum cleaning. In this exemplary illustration, brushroll 546 includes a dowel 46, a plurality of tufted bristles 48 or unitary bristle strips extending from the dowel 46, and microfiber material 49 provided on the dowel 46, arranged between the bristles 48. Dowel 46 can be constructed of a polymeric material such as acrylonitrile butatdiene styrene (ABS), polypropylene or styrene, or any other suitable material such as plastic, wood, or metal. Bristles 48 can be tufted or unitary bristle strips and constructed of nylon, or any other suitable synthetic or natural fiber. The microfiber material 49 can be constructed of polyester, polyamides, or a conjugation of materials including polypropylene or any other suitable material known in the art from which to construct microfiber.

In one non-limiting example, dowel 46 is constructed of ABS and formed by injection molding in one or more parts. Bristle holes (not shown) can be formed in the dowel 46 by drilling into the dowel 46 after molding, or can be integrally molded with the dowel 46. The bristles 48 are tufted and constructed of nylon with a 0.15 mm diameter. The bristles 48 can be assembled to the dowel 46 in a helical pattern by pressing bristles 48 into the bristle holes and securing the bristles 48 using a fastener (not shown), such as, but not limited to, a staple, wedge, or anchor. The microfiber material 49 is constructed of multiple strips of polyester treated with Microban© and glued onto the dowel 46 between bristles 48. Alternatively, one continuous microfiber strip 49 can be used and sealed by hot wire to prevent the single strip from detaching from the dowel 46. The polyester material can be 7-14 mm thick with weight of 912 g/m$^2$. The polyester material can be an incipient absorption of 269 wt % and a total absorption of 1047 wt %.

FIG. 10 is a close-up sectional view through a forward section of the suction nozzle assembly 580. The brushroll 546 is positioned for rotational movement in a direction R about a central rotational axis X. The suction nozzle assembly 580 includes a suction nozzle 594 defined within the brush chamber 565 that is in fluid communication with the foot conduit 564 and configured to extract liquid and debris from the brushroll 546 and the surface to be cleaned. The suction nozzle 594 defines a dirty air inlet of the working air path or recovery pathway through the vacuum cleaner. Suction nozzle 594 is further fluidly connected through the foot conduit 564 and the flexible hose conduit 518, to dirty tank assembly 400 (see FIG. 16B). Front interference wiper 560, mounted at a forward position of the nozzle housing 551, is provided in the brush chamber 565, and is configured to interface with a leading portion of the brushroll 546, as defined by the direction of rotation R of the brushroll 546. Spray tips 554 are mounted to the nozzle housing 551 with an outlet in the brushroll chamber 565 and oriented to spray fluid inwardly onto the brushroll 546. The wetted portion brushroll 546 then rotates past the interference wiper 560, which scrapes excess fluid off the brushroll 546, before reaching the surface to be cleaned. Rear wiper squeegee 538 is mounted to the cover base 537 behind the brushroll 546 and is configured to contact the surface as the base 14 moves across the surface to be cleaned. The rear wiper squeegee 538 wipes residual liquid from the surface to be cleaned so that it can be drawn into the fluid recovery pathway via the suction nozzle 594, thereby leaving a moisture and streak-free finish on the surface to be cleaned.

Front interference wiper 560 and rear wiper 538 can be squeegees constructed of a polymeric material such as polyvinyl chloride, a rubber copolymer such as nitrile butadiene rubber, or any material known in the art of sufficient rigidity to remain substantially undeformed during normal use of the vacuum cleaner 10, and can be smooth or optionally include nubs on the ends thereof. Wiper 560 and wiper 538 can be constructed of the same material in the same manner or alternatively constructed of different materials providing different structure characteristics suitable for function.

Figure 11:
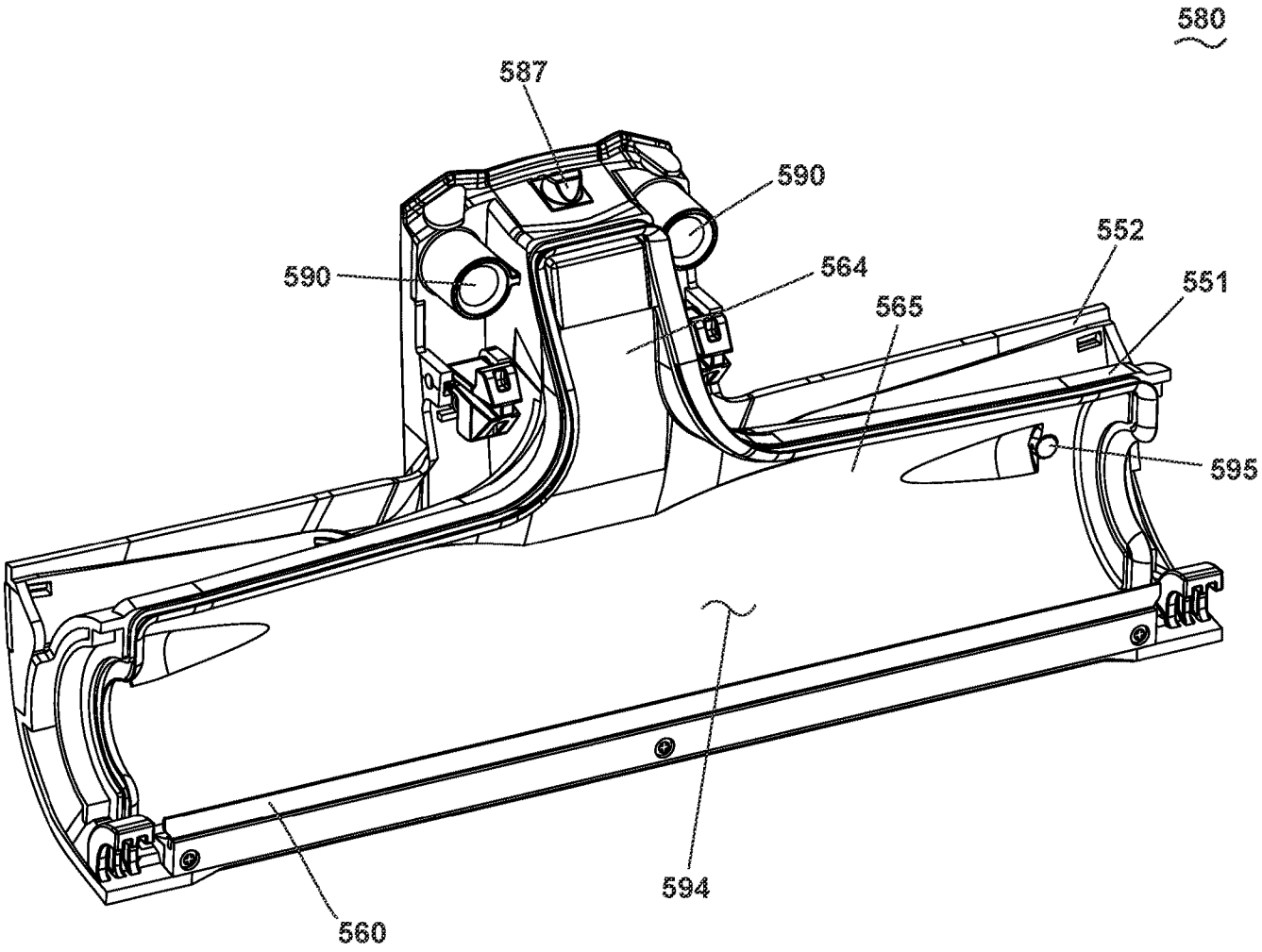
FIG. 11 is a perspective view of the underside of the suction nozzle assembly, with portions cut away to show internal features of the suction nozzle assembly.

FIG. 11 is a perspective view of the underside of the suction nozzle assembly 580, with some portions cut away to show some internal features of the suction nozzle assembly 580. Brushroll chamber 565 is defined on the underside of suction nozzle assembly 580 forward of the foot conduit 564. A pair of spray tip outlets 595 can be provided in the brush chamber 565. A latch mechanism 587 is provided at the rearward portion of suction nozzle assembly 580 and is configured to be received in the upper cover 542 (FIG. 8). Latch mechanism 587 can be received in a latch receiving depression 587*a* (FIG. 8) provided on the upper cover 542 base 14 and is configured for a user to remove and/or lock the suction nozzle assembly 580 onto the base 14. The suction nozzle assembly 580 can be biased by springs 556 to release suction nozzle assembly 580 away from foot assembly 500 when the latch mechanism 587 is actuated. A pair of spray connector inlets 590 are provided on the underside of nozzle housing 551 and are fluidly connected to the first terminal end of fluid delivery channels 40 on the upper side of the nozzle housing 551 (FIG. 8). Front interference wiper 560 is provided in the forward most portion of brushroll chamber 565.

Figure 12:
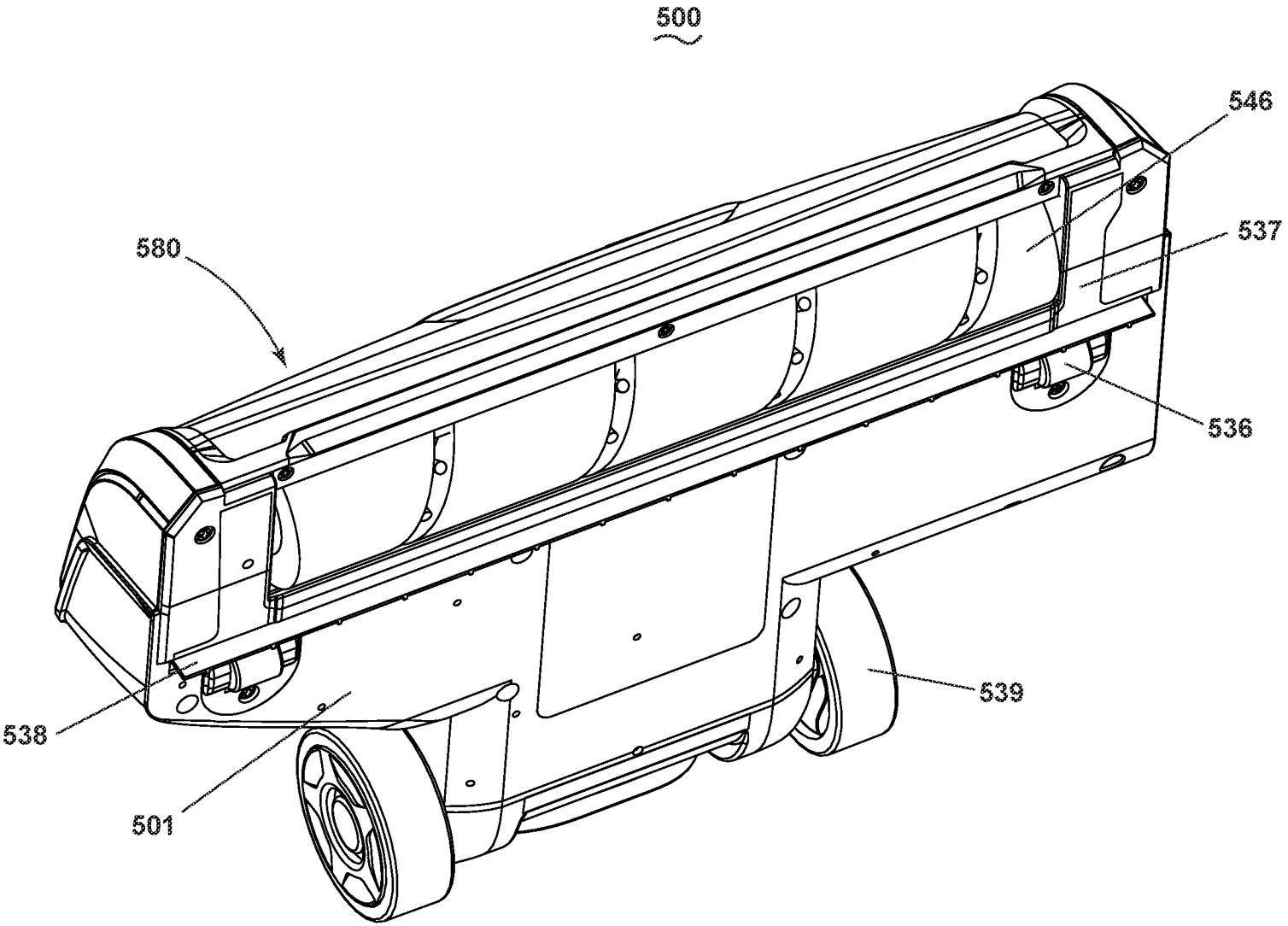
FIG. 12 is a bottom perspective view of the foot assembly of suction nozzle assembly FIG. 1.

FIG. 12 is a bottom perspective view of the foot assembly 500. Rear wiper 538 is provided on the cover base 537, rearward of brushroll 546, and configured to contact the surface to be cleaned.

Figure 13A:
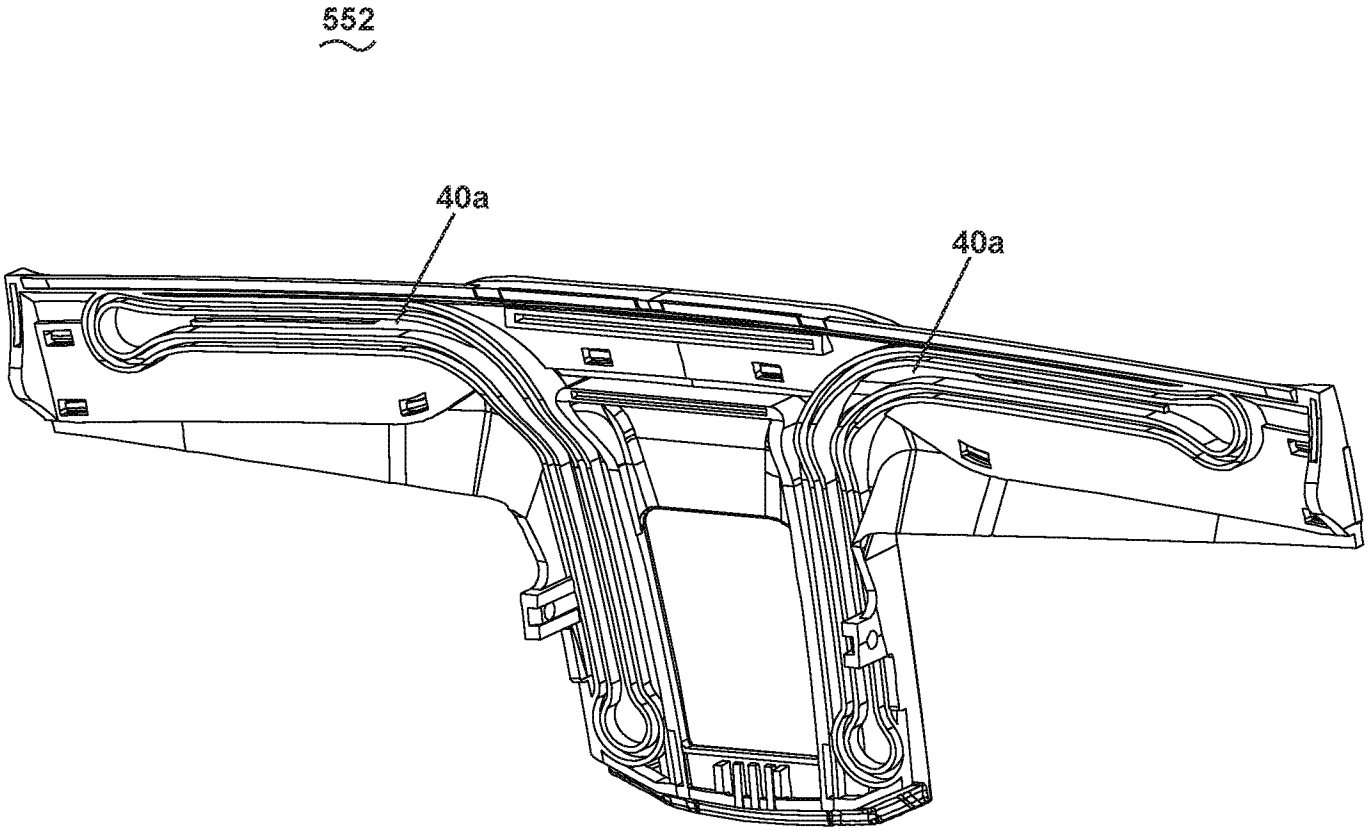
FIG. 13A is a perspective view of a lens cover of the suction nozzle assembly.
Figure 13B:
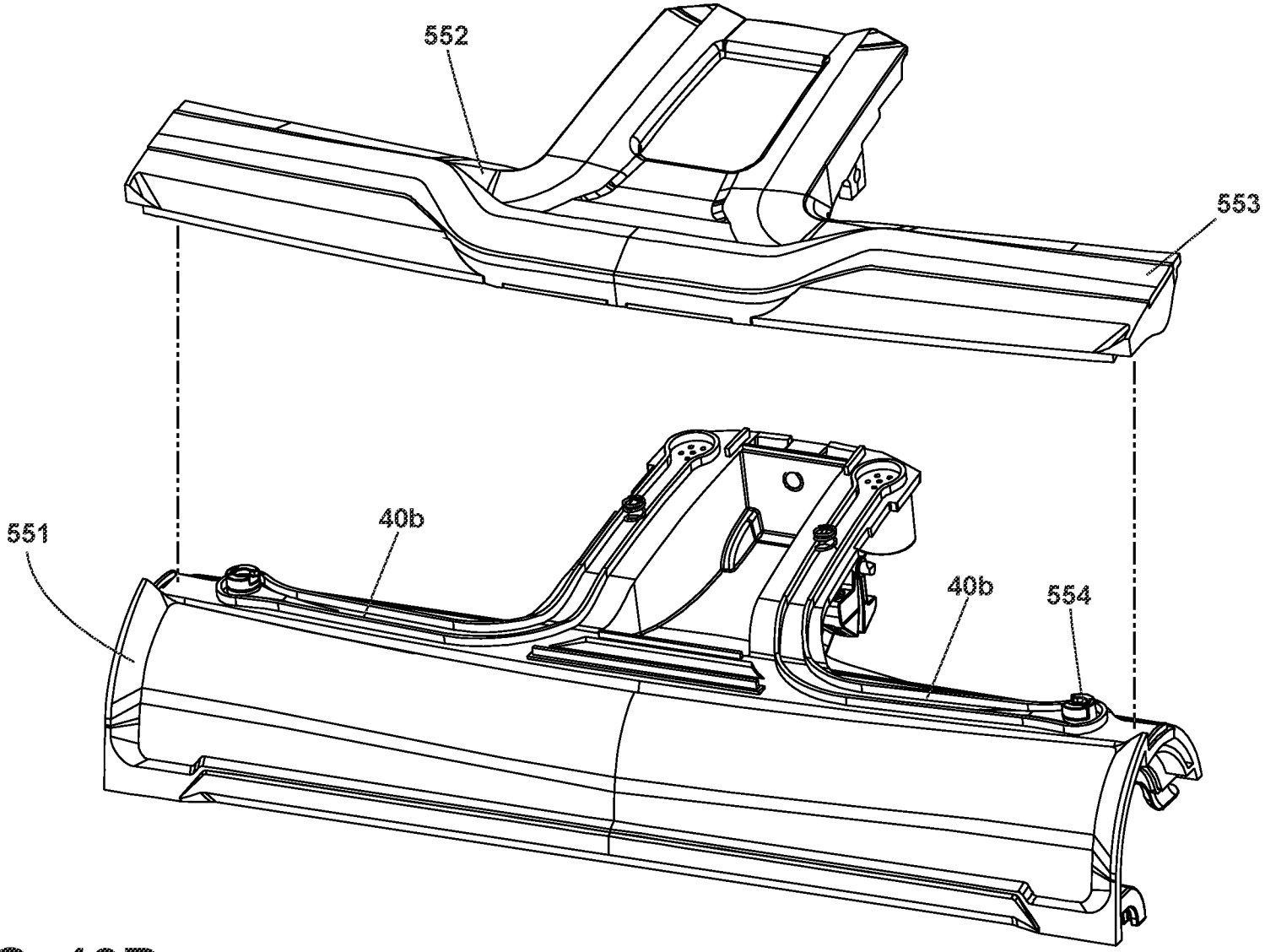
FIG. 13B is an exploded perspective view of the suction nozzle assembly.

FIG. 13A is a perspective view of the underside of the nozzle cover 552 and FIG. 13B is an exploded perspective view of the suction nozzle assembly 580. The nozzle cover 552 is included of two fluid channel portions 40*a* that form an upper portion of the flow channels 40 when mated with nozzle housing 551. The nozzle housing 551 includes two fluid channel portions 40*b* that form lower portions of the flow channels 40 when mated with the nozzle cover 552. Fluid channel portions 40*a* and 40*b* mate to form the fluid delivery flow channels 40 therebetween containing the spray tips 554 at the second terminal ends partially therein.

The nozzle housing 551 can define a lens for the brush chamber 565 and can be included of a translucent or transparent material to allow the brushroll 546 to be viewed therethough. Likewise, the nozzle cover 552 can define a lens cover, and can be included of a translucent or transparent material, which permits a user to view the flow of fluid through the flow channels 40.

Figure 14:
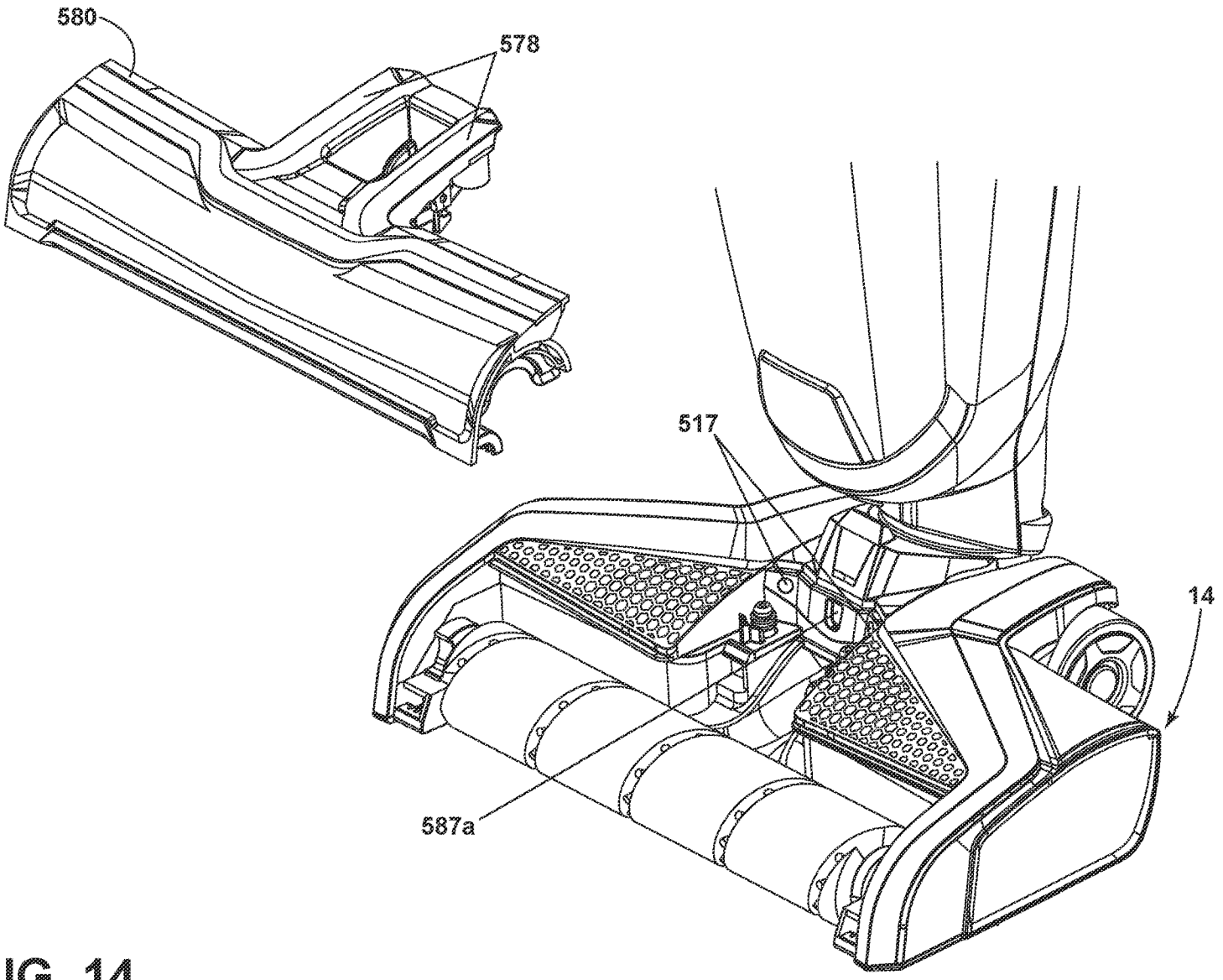
FIG. 14 is a partially exploded view of the foot assembly.

FIG. 14 is a partially exploded view of the base. In FIG. 14, suction nozzle assembly 580 is removed to expose the indicator lights 517. The indicator lights 517 can be configured to activate in combination with the pump assembly 140 when trigger 113 is depressed to deliver fluid (FIG. 2). A portion of the base can form a light tube or light pipe 578 that is illuminated by the indicator lights 517 when fluid is delivered, indicating to the user that fluid is being delivered to the surface underneath the base 14. The light pipe 578 can be any physical structure capable of transporting or distributing light from the indicator lights 517. The light pipe 578 can be a hollow structure that contain the light with a reflective lining, or a transparent solid structure that contain the light by total internal reflection. In the illustrated example, light pipes 578 are solid structures formed on the suction nozzle assembly 580 and are elongated to extend along the fluid delivery channels 40 and configured to distribute of light over its length. More specifically, the light pipes 578 are embodied as raised rails molded onto the surface of the nozzle cover 552, generally above the fluid delivery channels 40.

Figure 15:
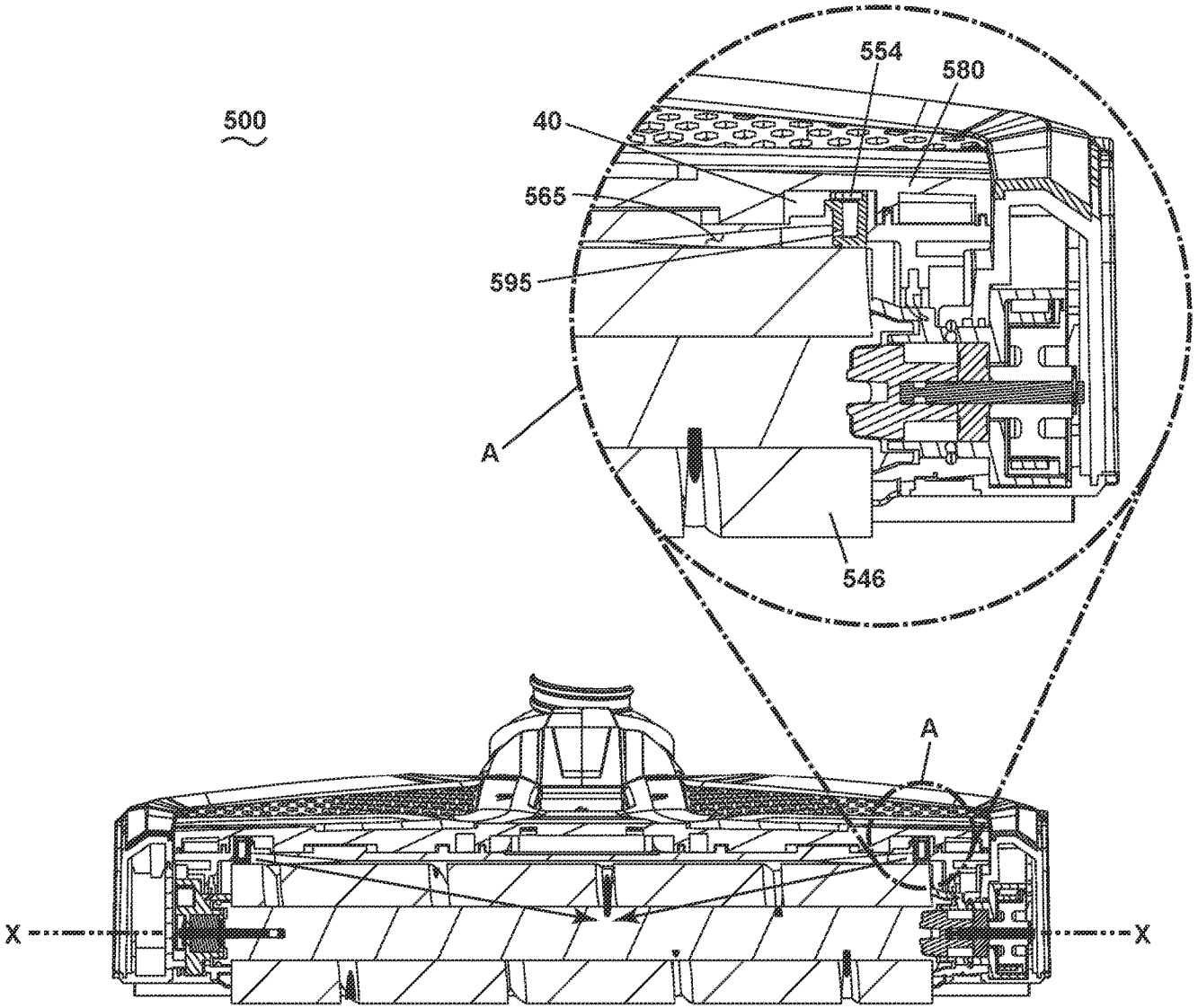
FIG. 15 is a cross-sectional view of the foot assembly of FIG. 1 through line XV-XV of FIG. 1 and includes an enlarged view of section A, showing a fluid dispenser of the surface cleaning apparatus of FIG. 1.

FIG. 15 is a cross-sectional view of the foot assembly 500 through line XV-XV of FIG. 1, with portion A enlarged for a close up view of a fluid dispenser in the form of the spray tip 554. The spray tip 554 is mounted in each of the terminal ends of each of the fluid delivery flow channels 40 of the suction nozzle assembly 580 and can be configured to terminate in the brush chamber 565. Each spray tip 554 includes an orifice 595 oriented to spray onto the brushroll 546 as depicted by the solid arrows in FIG. 15. The spray tips 554 can be oriented to spray along a horizontal axis which may be parallel to the rotational axis X of the brushroll 546 or at a substantially horizontal angle relative to the rotational axis X in order to wet the entire length of the brushroll 546 during fluid dispensing. By "substantially horizontal" the angle of spray of the orifice 595 can be 0 to 30 degrees, depending on the length of the brushroll and the spacing of the spray tips 554 in order to cover the entire brushroll 546 with fluid. The angle of the spray tips 554 may be static or adjustable while the multi-surface wet vacuum cleaner 10 is in operation or prior to operation. The spray tip outlet orifice 595 can have any diameter suitable to deliver fluid at the desired pressure, pattern, and/or volume from the spray tip 554. In the present example, spray tips 554 have an outlet orifice diameter of 1.0 mm and are oriented to spray inwardly onto a top of the brushroll 546 at an angle of 15 degrees from the horizontal.

Figure 16A:
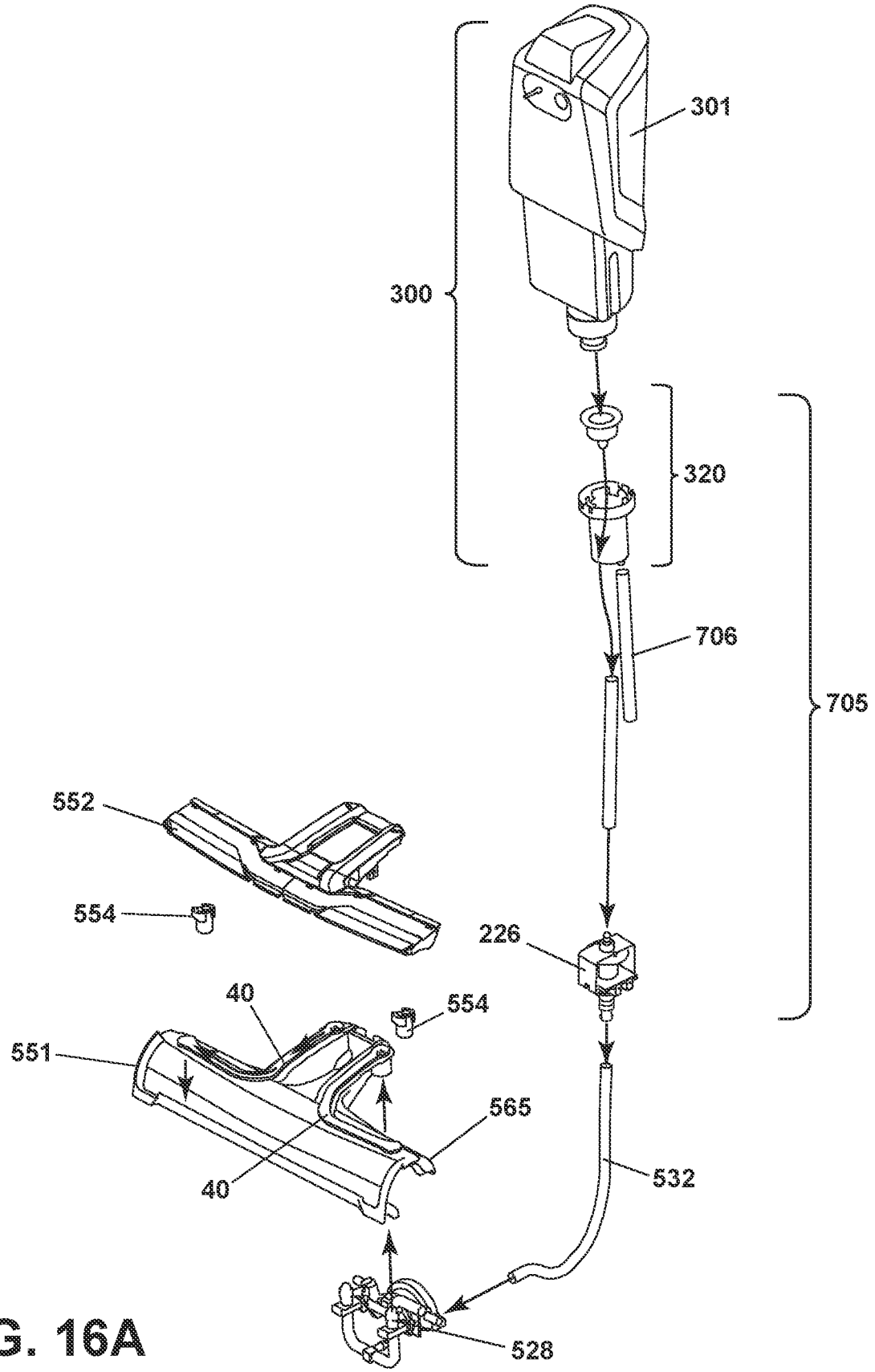
FIG. 16A is a schematic diagram of a fluid delivery pathway of the surface cleaning apparatus of FIG. 1.

FIG. 16A is a schematic diagram of a fluid supply pathway of the vacuum cleaner 10. The arrows present designate the directional flow of fluid in the fluid supply pathway according to the present example. The fluid supply pathway can include the supply tank 301 for storing a supply of fluid. The fluid can include one or more of any suitable cleaning fluids, including, but not limited to, water, compositions, concentrated detergent, diluted detergent, etc., and mixtures thereof. For example, the fluid can include a mixture of water and concentrated detergent.

Figure 19:
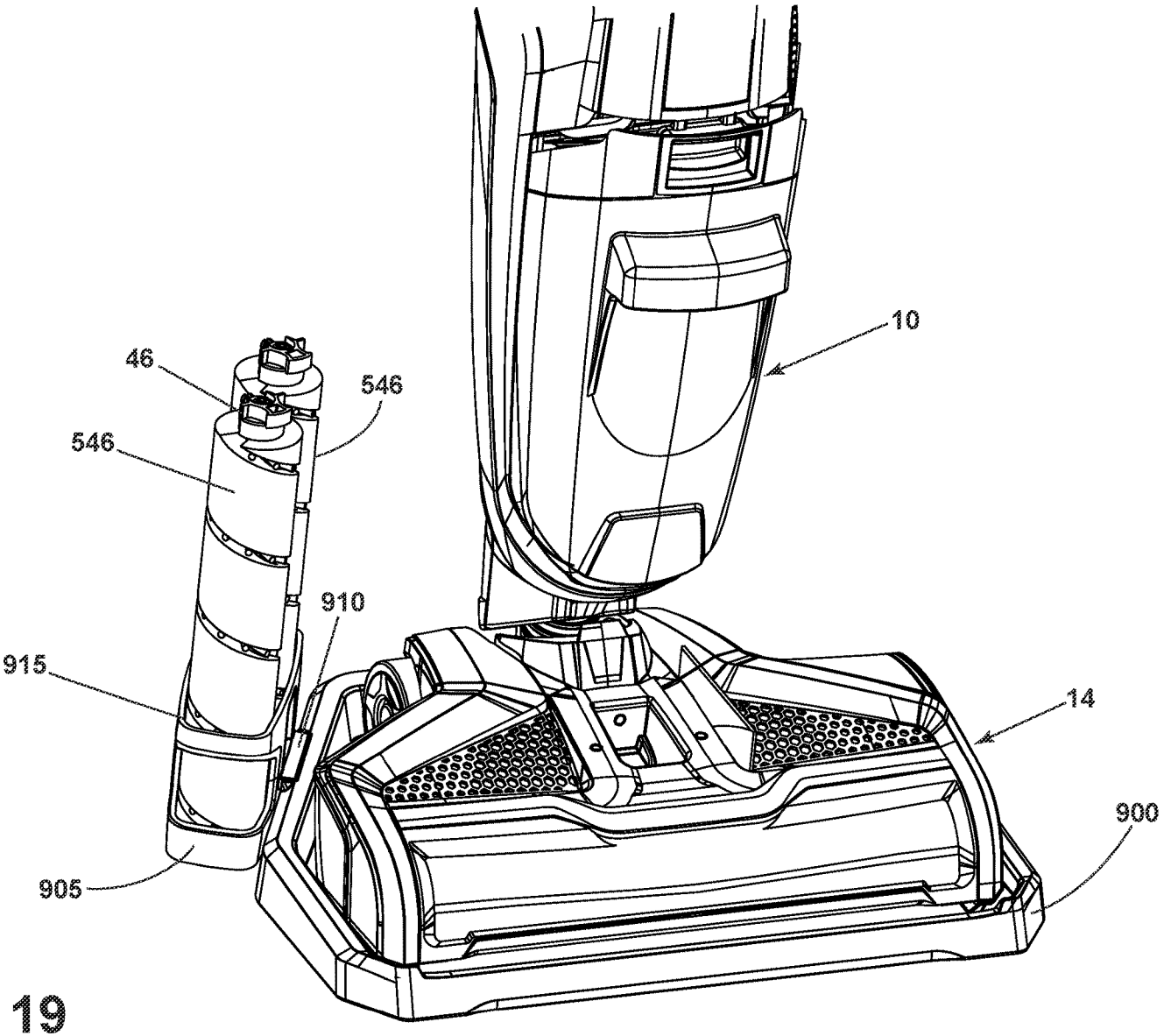
FIG. 19 is a perspective view of a storage tray to receive the surface cleaning apparatus of FIG. 1 and at least one extra brushroll.

The fluid supply pathway can further include a flow control system 705 for controlling the flow of fluid from the supply tank 301 to fluid supply conduit 532. In one configuration, the flow control system 705 can include pump 226, which pressurizes the system, and supply valve assembly 320, which controls the delivery of fluid to the fluid supply conduit 532. In this configuration, fluid flows from the supply tank 301, through pump 226, to the fluid supply conduit 532. A drain tube 706 provides a pathway for draining any fluid that may leak from the supply tank 301 while the vacuum cleaner 10 is not in active operation to a drain hole (not pictured) in foot assembly 500 to collect in a storage tray 900 (FIG. 19). From the fluid supply conduit 532, fluid flows sequentially through the spray connectors 528, through the fluid delivery channels 40, through the spray tips 554, and onto the brushroll 546 (FIG. 15), which applies the fluid to the surface to be cleaned.

The trigger 113 (FIG. 2) can be depressed to actuate the flow control system 705 and dispense fluid to the fluid dispenser 554. The trigger 113 can be operably coupled to the supply valve 320 such that pressing the trigger 113 will open the valve 320. The valve 320 can be electrically actuated, such as by providing an electrical switch between the valve 320 and a power source 22 (FIG. 18) that is selectively closed when the trigger 113 is pressed, thereby powering the valve 320 to move to an open position. In one example, the valve 320 can be a solenoid valve. The pump 226 can also be coupled with the power source 22. In one example, the pump 226 can be a centrifugal pump. In another example, the pump 226 can be a solenoid pump.

In another configuration of the fluid supply pathway, the pump 226 can be eliminated and the flow control system 705 can include a gravity-feed system having a valve fluidly coupled with an outlet of the supply tank(s) 301, whereby when valve is open, fluid will flow under the force of gravity to the fluid dispenser 554. The valve 320 can be mechanically actuated or electrically actuated, as described above.

Figure 16B:
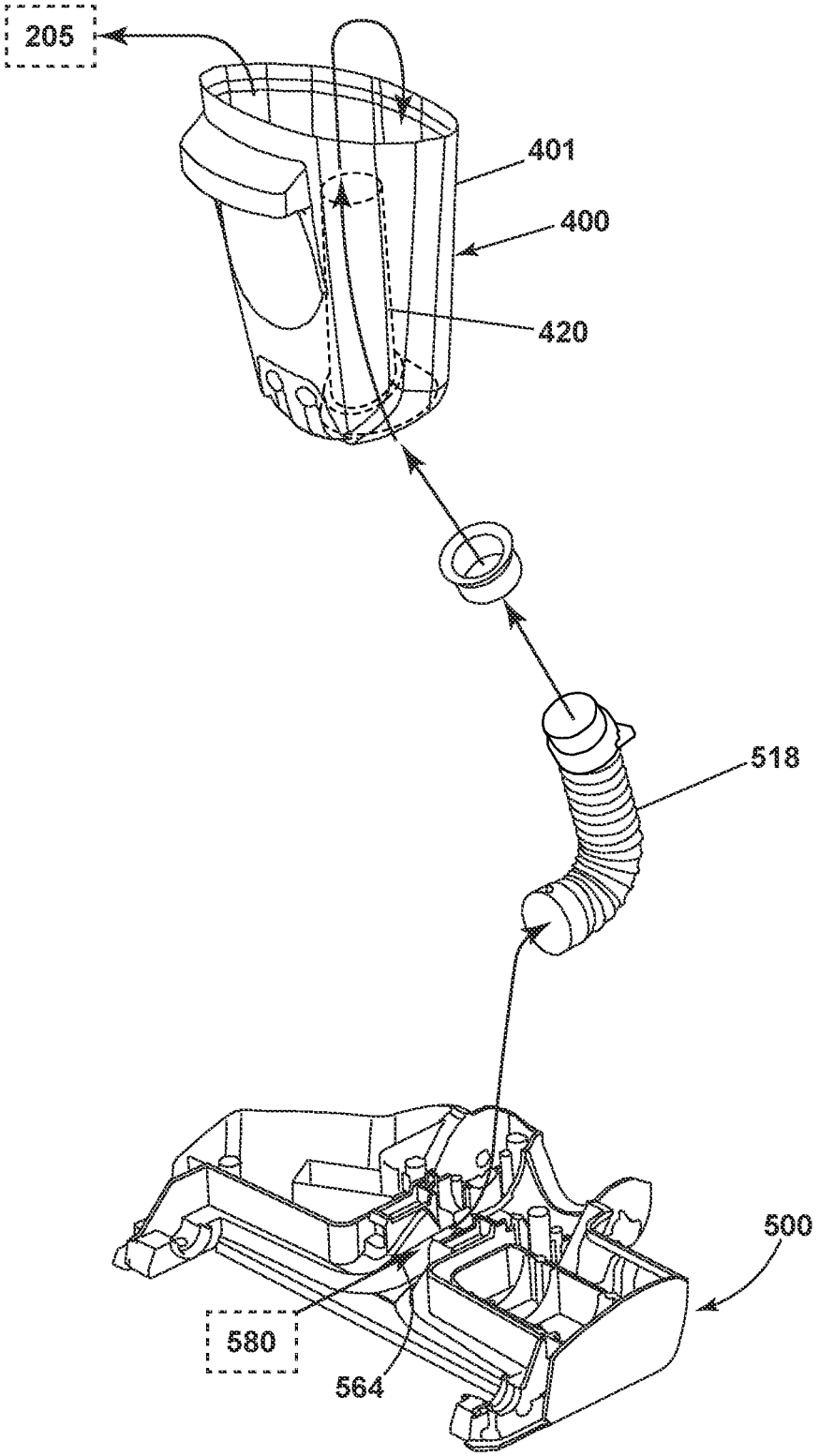
FIG. 16B is a schematic diagram of a fluid recovery pathway of the surface cleaning apparatus of FIG. 1.

FIG. 16B is a schematic diagram of a fluid recovery pathway of the vacuum cleaner 10. The arrows present designate the directional flow of fluid in the fluid recovery pathway. The fluid recovery pathway can include the suction nozzle assembly 580, the foot conduit 564, the flexible conduit hose 518, the suction motor/fan assembly 205 in fluid communication the suction nozzle assembly 580 for generating a working air steam, and recovery tank 401 for separating and collecting fluid and debris from the working airstream for later disposal. Standpipe 420 can be formed in a portion of recovery tank 401 for separating fluid and debris from the working airstream. The suction motor/fan assembly 205 provides a vacuum source in fluid communication with the suction nozzle assembly 580 to draw the fluid and debris from the surface to be cleaned through the flexible hose conduit 518 to the recovery tank 401.

Figure 17:
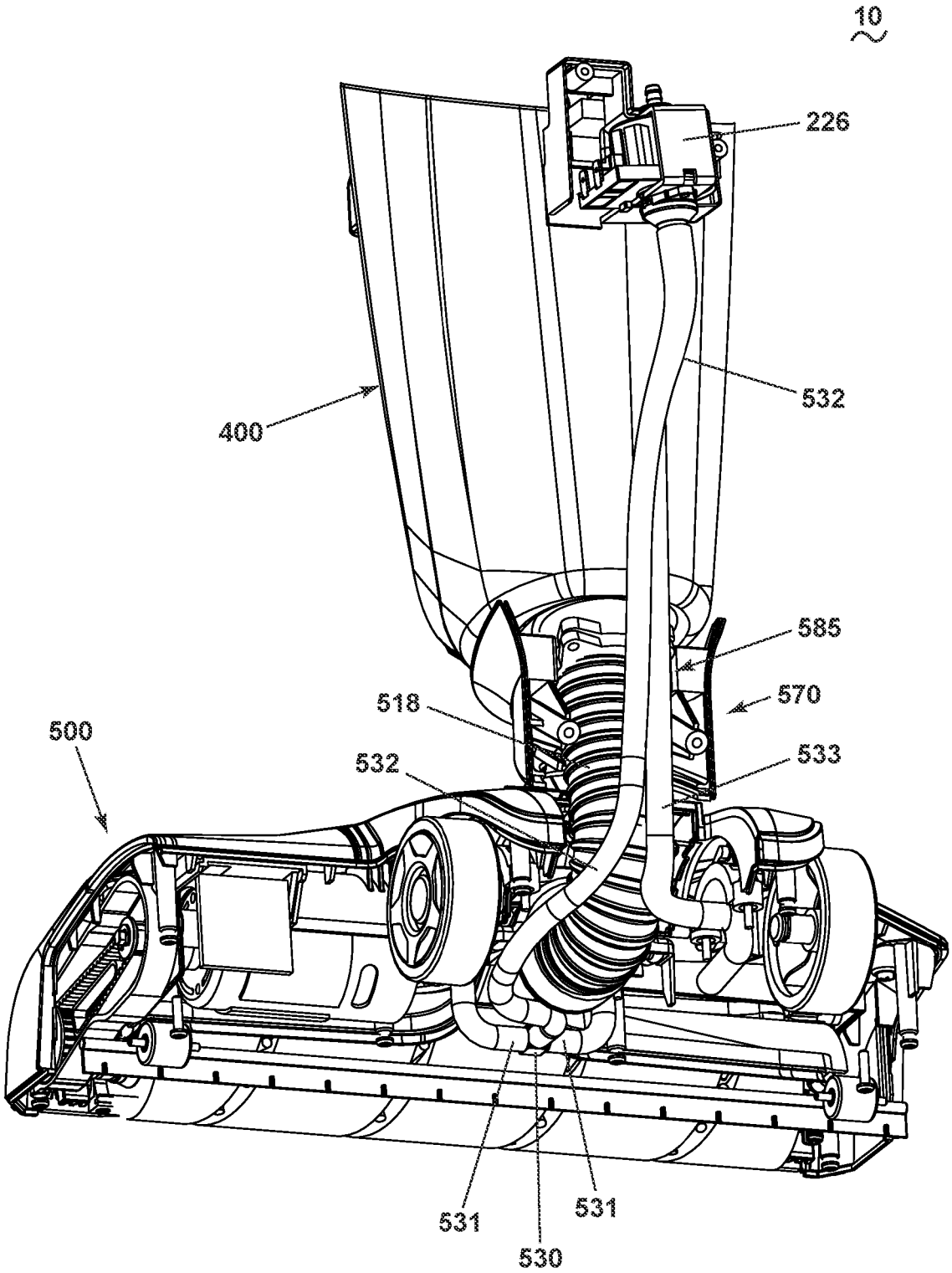
FIG. 17 is a rear perspective view of the surface cleaning apparatus of FIG. 1 with portions removed to show a conduit assembly.

FIG. 17 is a rear perspective view of the vacuum cleaner 10 with portions removed to show the conduit assembly 585. In the present example, flexible conduit hose 518 couples dirty tank assembly 400 to foot assembly 500 through a forward portion of pivotable swivel joint assembly 570. Fluid supply conduit 532 and wiring conduit 533 can be provided rearward of flexible conduit hose 518. Fluid supply conduit 532 fluidly couples the pump 226 the T-connector 530 in the foot assembly 500.

Figure 18:
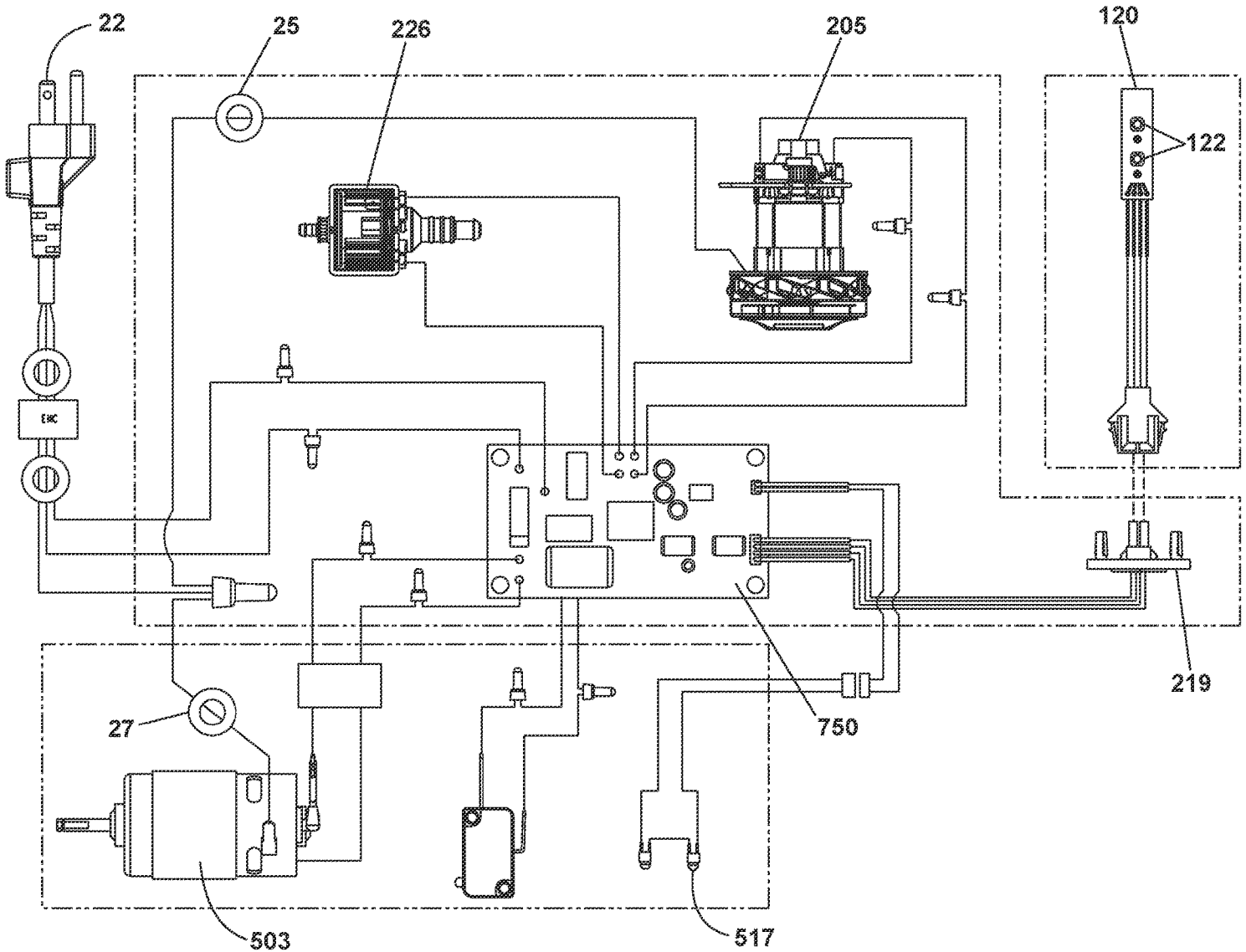
FIG. 18 is a schematic circuit diagram of the surface cleaning apparatus of FIG. 1.

FIG. 18 is a schematic circuit diagram of the vacuum cleaner 10. User interface assembly 120 can be operably connected to the various components of cleaner 10 directly or through a central control unit 750. User interface assembly 120 can include one or more actuators and be configured with any combination of buttons, switches, toggles, triggers, or the like to allow a user to select multiple cleaning modes and/or control the fluid delivery and recovery systems. A power source 22, such as a battery or power cord plugged into a household outlet, can be electrically coupled to the electrical components of the vacuum cleaner 10, including the motors 205, 503 and pump 226. A suction power switch 25 between the suction motor/fan assembly 205 and the power source 22 can be selectively closed by the user, thereby activating the suction motor/fan assembly 205. Furthermore, a brush power switch 27 between the brush motor 503 and the power source 22 can be selectively closed by the user, thereby activating the brush motor 503. User interface assembly 120 can be operably coupled to the pump 226 such that an actuator, such as trigger 113, can activate the pump 226 when engaged, thereby powering the pump 226 to deliver fluid to the fluid supply pathway. Actuation of the pump 226 can be operably connected to the LED lights 517 such that actuation of trigger 113 additionally powers LED indicator lights 517 to provide user feedback that fluid is being delivered to the fluid supply pathway.

In one example, user interface assembly 120 of vacuum cleaner 10 can be provided with actuators 122 for selecting multiple cleaning modes to be selected by the user. Actuators 122 send a signal to the central control unit 750, which can include a PCBA. The output from the central control unit 750 adjusts the frequency of the solenoid pump 226 to generate the desired flow rate depending on the mode selected. For instance, the vacuum cleaner 10 can have a hard floor cleaning mode and a carpet cleaning mode. In the hard floor cleaning mode, the liquid flow rate to the fluid dispenser 554 is less than in the carpet cleaning mode. The liquid flow rate is controlled by the speed of the pump 226. In one non-limiting example, the speed of the pump 226 is controlled in the hard floor cleaning mode so that the liquid flow rate is approximately 50 ml/min and the speed of the pump 226 is controlled in the carpet cleaning mode so that the liquid flow rate is approximately 100 ml/min. Optionally, the vacuum cleaner 10 can have a wet scrubbing mode in which the suction motor/fan assembly 205 can be inoperative while brush motor 503 is activated so that the soiled cleaning solution is not removed from the surface to be cleaned.

FIG. 19 is a perspective view of a storage tray 900 for the vacuum cleaner 10. Storage tray 900 can be configured to receive the base 14 of the vacuum cleaner 10 in an upright, stored position. Storage tray 900 can optionally be adapted to contain a liquid for the purposes of cleaning the interior parts of cleaner 10 and/or receiving liquid from the drain tube 706 (FIG. 16A). In the present example, storage tray 900 is adapted to receive the base 14 and includes a removable brushroll holder 905 provided on an exterior side wall of the tray 900. Alternatively, storage tray 900 can be configured with an integral brushroll holder 905. Here, the brushroll holder 905 can be secured to the storage tray 900 by a retention latch 910. Retention latch 910 can include a sliding lock, clamp, brace, or any other mechanism in which to secure brushroll holder 905 to its position on storage tray 900 while in use and can be biased or otherwise configured to allow a user to release a lock and remove the brushroll holder 905 from storage tray 900. Brushroll holder 905 can be adapted to removably receive one or more brushrolls 546 for the purposes of storage and/or drying. Brushroll holder 905 can include one or more brushroll slots 915 to securely receive brushrolls 546 in a vertical fixed position for drying and storage. Brushroll slots 915 can be fixed or adjustable and can be included of clamps, rods, or molded receiving positions that can accommodate brushroll 546 with or without the dowel 46 inserted. Alternatively, brushroll holder 905 can include a series of horizontal storage positions such racks, hooks, or clamps (not shown) to secure brushrolls 546 in a horizontal position.

The multi-surface wet vacuum cleaner 10 shown in the figures can be used to effectively remove debris and fluid from the surface to be cleaned in accordance with the following method. The sequence of steps discussed is for illustrative purposes only and is not meant to limit the method in any way as it is understood that the steps may proceed in a different logical order, additional or intervening steps may be included, or described steps may be divided into multiple steps, without detracting from the present disclosure.

In operation, the multi-surface wet vacuum cleaner 10 is prepared for use by coupling the vacuum cleaner 10 to the power source 22, and by filling the supply tank 301 with cleaning fluid. A user selects the floor surface type to be cleaned through user interface assembly 120. Cleaning fluid is selectively delivered to the surface to be cleaned via the fluid supply pathway by user-activation of the trigger 113, while the vacuum cleaner 10 is moved back and forth over the surface. Pump 226 can be activated by user interface assembly 120. User-activation of trigger 113 activates the pump 226 and fluid is released by clean tank assembly 300 into the fluid delivery pathway through spray tips 554 and onto brushroll 546. The wetted brushroll 546 is wiped across the surface to be cleaned to remove dirt and debris present on the surface.

Activation of the trigger 113 also simultaneously activates LED indicator lights 517 which transmit light through the LED lenses 545 and into nozzle cover 552 along the light pipes 578 to provide an illuminated indication that fluid is being dispensed. The illumination of the LEDs 517 and light pipes 578 indicate to the user the fluid dispenser 554 has been activated and fluid has been dispensed onto the surface to be cleaned.

Simultaneously, brush power switch 27 can activate brushroll 546 to agitate or rotate cleaning fluid into the surface to be cleaned. Such interaction removes the adhered dirt, dust, and debris, which then become suspended in the cleaning fluid. As brushroll 546 rotates, front interference squeegee 560 confronts brushroll 546 in a manner so as to ensure the brush is wetted evenly and cleaning fluid is spread uniformly across the entire length of the brushroll 546. Front interference squeegee 560 can also be configured to simultaneously scrape soiled fluid and debris off the brushroll 546 to be drawn into the suction nozzle assembly 580 and fluid recovery pathway. As the vacuum cleaner 10 moves over the surface to be cleaned, soiled cleaning fluid and dirt near the nozzle opening 594 is drawn into the suction nozzle assembly 580 and the fluid recovery pathway when suction motor/fan assembly 205 is activated. Additionally, cleaning fluid and dirt is scraped by the rear wiper squeegee 538 and drawn into the fluid recovery pathway.

Optionally, during operation of the brushroll 546, the suction motor/fan assembly 205 can be inoperative which facilitates a wet scrubbing mode so that the soiled cleaning solution is not removed as the cleaner 10 is moved back and forth across the surface to be cleaned.

During operation of the fluid recovery pathway, the fluid and debris-laden working air passes through the suction nozzle assembly 580 and into the downstream recovery tank 401 where the fluid debris is substantially separated from the working air. The airstream then passes through the suction motor/fan assembly 205 prior to being exhausted from the vacuum cleaner 10 through the clean air outlet defined by the vents 213, 214. The recovery tank 401 can be periodically emptied of collected fluid and debris by actuating the latch 430 and removing the dirty tank assembly 400 from the body assembly 200.

When operation has ceased, the vacuum cleaner 10 can be locked upright and placed into the storage tray 900 for storage or cleaning. If needed, the suction nozzle assembly 580 can be removed from the foot assembly 500. Brushroll 546 can then be removed from the foot assembly 500 and placed in brushroll holder 905.

The multi-surface wet vacuum cleaner 10 can optionally be provided with a self-cleaning mode. The self-cleaning mode can be used to clean the brushroll and internal components of the fluid recovery pathway of vacuum cleaner 10. The multi-surface wet vacuum cleaner 10 is prepared for cleaning by coupling the vacuum cleaner 10 to the power source 22, and by filling the storage tray 900 to a predesignated fill level with a cleaning fluid or water. The user selects the designated cleaning mode from the user interface assembly 120. In one example, locking mechanism 586 is released to pivot upright assembly 12 rearward and the hard floor cleaning mode is selected from the user interface assembly 120 by the user. Brushroll 546 is activated by brush motor 503 while suction motor/fan assembly 205 provides suction to the suction nozzle assembly 580 which draws fluid in storage tray 900 and into the fluid recovery pathway for a predetermined amount of time or until the fluid in storage tray 900 has been depleted. When self-cleaning mode has been completed, vacuum cleaner 10 can be returned to the upright and locked position in storage tray 900 and brushroll 546 can be removed and stored as previously described.

To the extent not already described, the different features and structures of the various embodiments of the present disclosure, may be used in combination with each other as desired, or may be used separately. That one vacuum cleaner is illustrated herein as having all of these features does not mean that all of these features must be used in combination, but rather done so here for brevity of description. Furthermore, while the vacuum cleaner 10 shown herein has an upright configuration, the vacuum cleaner can be configured as a canister or portable unit. For example, in a canister arrangement, foot components such as the suction nozzle assembly 580 and brushroll 546 can be provided on a cleaning head coupled with a canister unit. Still further, the vacuum cleaner can additionally have steam delivery capability. Thus, the various features of the different embodiments may be mixed and matched in various vacuum cleaner configurations as desired to form new embodiments, whether or not the new embodiments are expressly described.

While the present disclosure has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A surface cleaning apparatus, comprising:

a housing including an upright handle assembly and a base operably coupled to the upright handle assembly;

an agitator selectively provided with the base;

a suction source;

a suction nozzle in fluid communication with the suction source;

a fluid delivery system including a fluid supply chamber adapted to hold a supply of liquid, a fluid dispenser provided on the base, a fluid delivery pathway between the fluid supply chamber and the fluid dispenser; and a dual wiper configuration provided with the base and comprising a first wiper adapted to contact the agitator and a second wiper at least selectively adapted to contact a surface to be cleaned.

2. The surface cleaning apparatus of claim 1 wherein the first wiper is positioned on a first side of the agitator and the second wiper is located on a second side of the agitator, generally opposite from the first side.

3. The surface cleaning apparatus of claim 2 wherein the agitator comprises a rotating brushroll.

4. The surface cleaning apparatus of claim 3 wherein the first wiper is an interference wiper adapted to interface with a leading portion of the rotating brushroll prior to rotation of the leading portion into contact with the surface to be cleaned.

5. The surface cleaning apparatus of claim 4 wherein the second wiper is a squeegee at least selectively adapted to contact the surface to be cleaned, the squeegee located to trail the rotating brushroll.

6. The surface cleaning apparatus of claim 1 wherein the fluid dispenser comprises at least one outlet orifice in the base and wherein the at least one outlet orifice is oriented to provide fluid onto the agitator.

7. The surface cleaning apparatus of claim 6 wherein the first wiper is an interference wiper adapted to interface with a portion of the agitator to at least one of distribute liquid on the agitator or remove excess liquid from the agitator.

8. The surface cleaning apparatus of claim 7 wherein the interference wiper is positioned proximate the suction nozzle.

9. The surface cleaning apparatus of claim 8 wherein the second wiper is a body at least selectively adapted to direct fluid to a fluid recovery pathway in the base.

10. The surface cleaning apparatus of claim 6 wherein the at least one outlet orifice comprises a first outlet and a second outlet and both the first outlet and the second outlet are configured to dispense fluid onto the agitator.

11. The surface cleaning apparatus of claim 1 wherein the base defines a chamber at least partially housing the agitator.

12. The surface cleaning apparatus of claim 11, further comprising at least one fluid delivery channel forming a portion of the fluid delivery pathway, the at least one fluid delivery channel provided on the base.

13. The surface cleaning apparatus of claim 12 wherein the at least a portion of the at least one fluid delivery channel is an integrated fluid delivery channel forming a portion of the fluid delivery pathway.

14. The surface cleaning apparatus of claim 1, further comprising a joint coupling the upright handle assembly to the base and wherein the upright handle assembly is moveable relative to the base between an upright stored position and an operating position and the second wiper is adapted to contact the surface to be cleaned when the upright handle assembly is in the operating position.

15. The surface cleaning apparatus of claim 14 wherein the joint is a pivotable joint.

16. The surface cleaning apparatus of claim 1, further comprising an actuator provided on the upright handle assembly and operably coupled with the fluid delivery system to delivery fluid to the fluid dispenser via the fluid delivery pathway.

17. The surface cleaning apparatus of claim 1 wherein the first wiper interfaces with the agitator.

18. The surface cleaning apparatus of claim 1 wherein the first wiper scrapes the agitator.

19. The surface cleaning apparatus of claim 1 wherein the first wiper confronts the agitator.

20. The surface cleaning apparatus of claim 1 wherein the first wiper is adapted to at least one of aid in spreading fluid evenly along a length of the agitator or remove excess fluid off the agitator.

* * * * *